US007408532B2

(12) United States Patent
Mizobata

(10) Patent No.: US 7,408,532 B2
(45) Date of Patent: Aug. 5, 2008

(54) PLASMA DISPLAY DEVICE AND DRIVE METHOD FOR USE IN PLASMA DISPLAY DEVICE

(75) Inventor: Eishi Mizobata, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 608 days.

(21) Appl. No.: 11/147,391

(22) Filed: Jun. 8, 2005

(65) Prior Publication Data

US 2005/0280610 A1 Dec. 22, 2005

(30) Foreign Application Priority Data

Jun. 9, 2004 (JP) ..... 2004-171327

(51) Int. Cl.
*G09G 3/28* (2006.01)

(52) U.S. Cl. ..... 345/63; 345/60; 345/62; 345/66; 345/68

(58) Field of Classification Search ..... 345/60–69, 345/690–699; 315/169.1–169.4; 313/450–456
See application file for complete search history.

(56) References Cited

U.S. PATENT DOCUMENTS

2005/0116892 A1* 6/2005 Park ..... 345/60
2006/0158390 A1* 7/2006 Hashimoto et al. ..... 345/67
2007/0046572 A1* 3/2007 Kang ..... 345/63
2007/0210991 A1* 9/2007 Lee ..... 345/66

FOREIGN PATENT DOCUMENTS

JP 2000-112430 A 4/2000
JP 2000-122603 A 4/2000

* cited by examiner

*Primary Examiner*—Vijay Shankar
(74) *Attorney, Agent, or Firm*—Sughrue Mion, PLLC

(57) ABSTRACT

Scan electrodes are provided separately in addition to sustain electrode pairs generating a sustain discharge. An Address-While-Display drive, in which a scan pulse and a sustain pulse are applied at the same timing, is conducted for each subfield. When scan pulses are applied to the scan electrodes, a wall voltage is generated by a wall charge formed on the dielectric layer located on the scan electrodes. This wall voltage is set higher in the negative voltage direction than the wall voltage generated by a wall charge formed on the dielectric layer located on the sustain electrode pairs. As a result, the display luminance level is increased, increase in the scale of power source circuit can be avoided, and a wide drive margin can be obtained.

19 Claims, 21 Drawing Sheets

FIG. 7 (1)
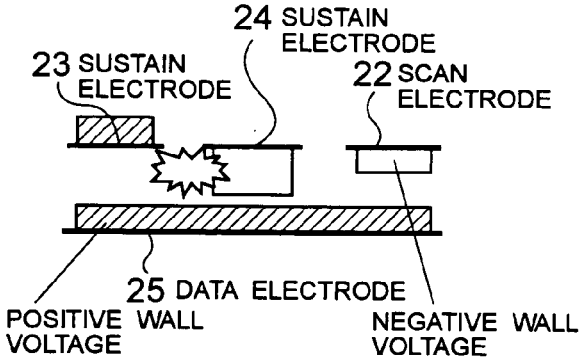
FIG. 7 (2)
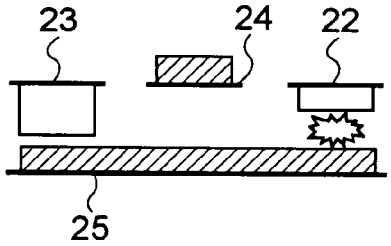
FIG. 7 (3)
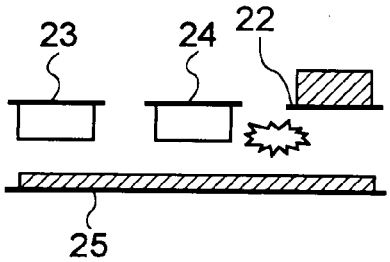
FIG. 7 (4)
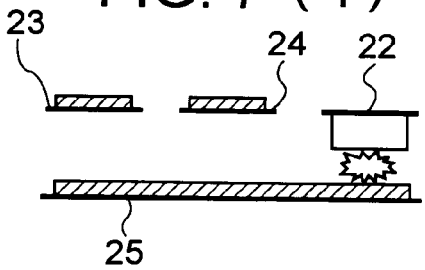
FIG. 7 (5)
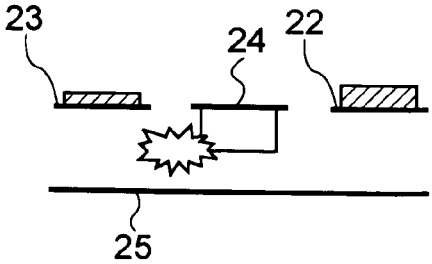
FIG. 7 (6)
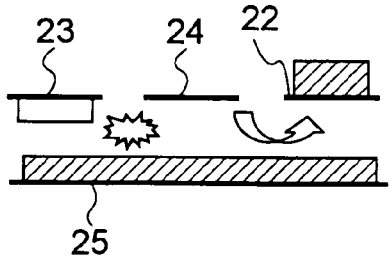
FIG. 7 (7)
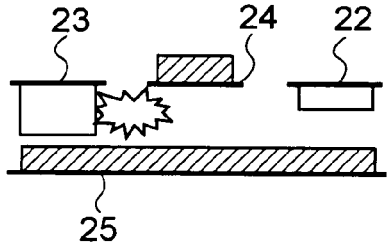
FIG. 7 (8)
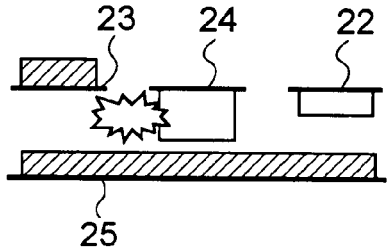

FIG. 11 (1)
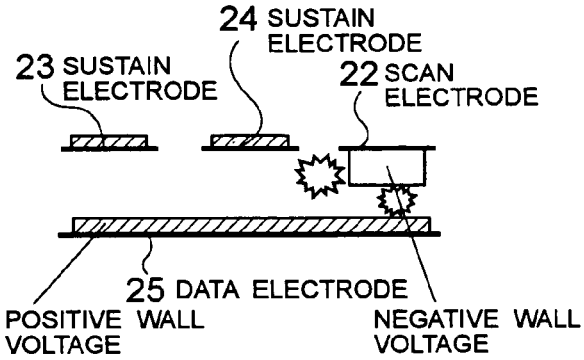
FIG. 11 (2)
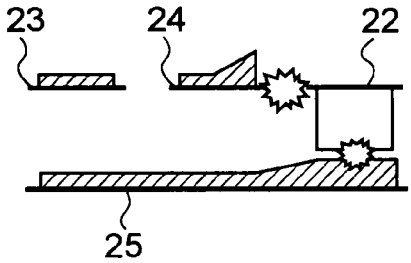
FIG. 11 (3)
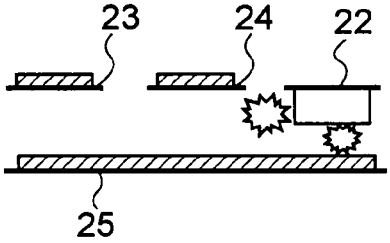
FIG. 11 (4)
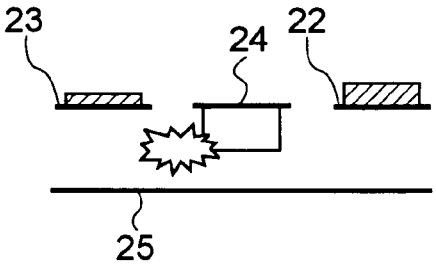
FIG. 11 (5)
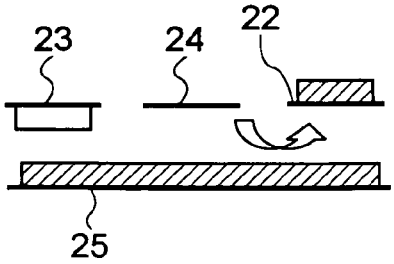
FIG. 11 (6)
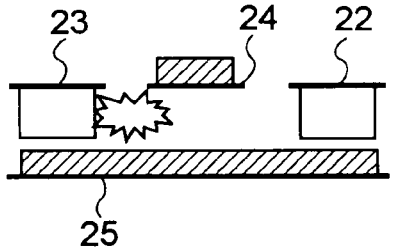
FIG. 11 (7)
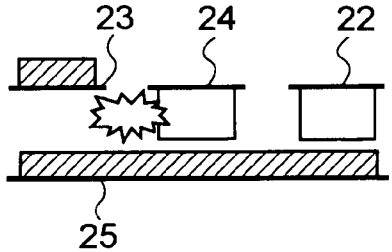

FIG. 18 (1)
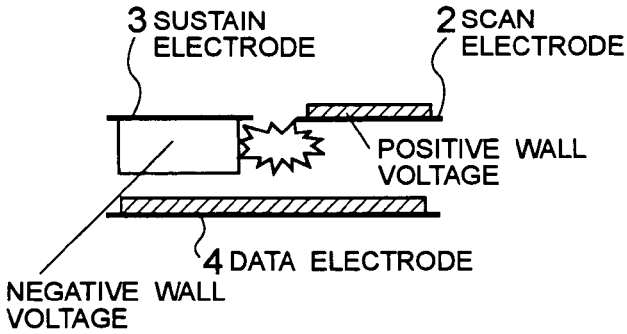
FIG. 18 (2)
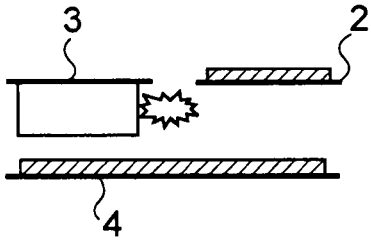
FIG. 18 (3)
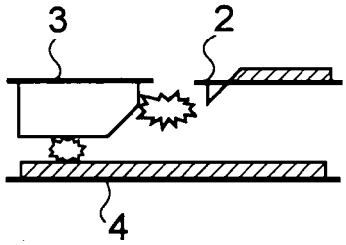
FIG. 18 (4)
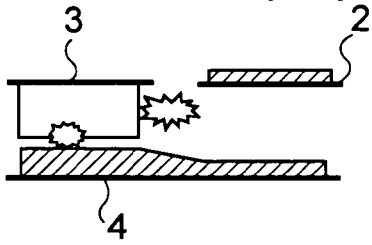
FIG. 18 (5)
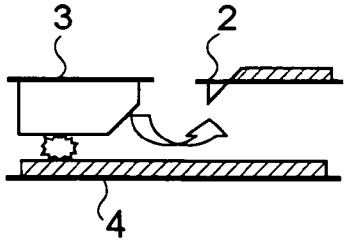
FIG. 18 (6)
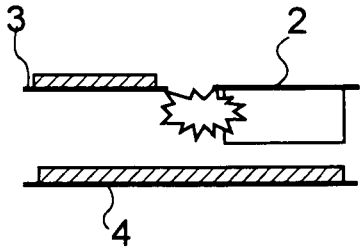
FIG. 18 (7)
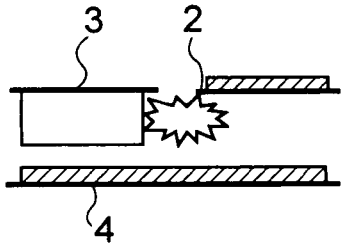

FIG. 21 (1)
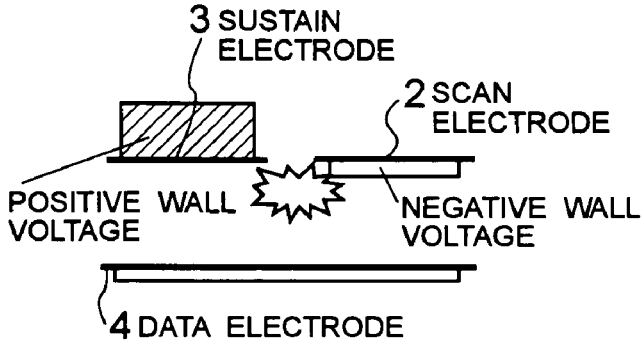
FIG. 21 (2)
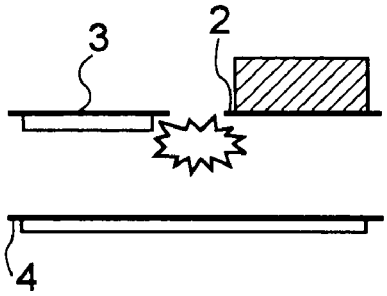
FIG. 21 (3)
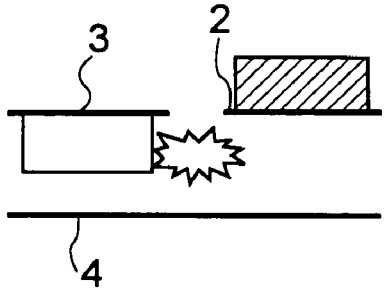
FIG. 21 (4)
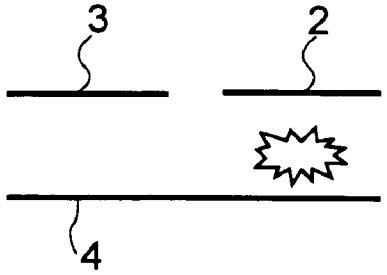
FIG. 21 (5)
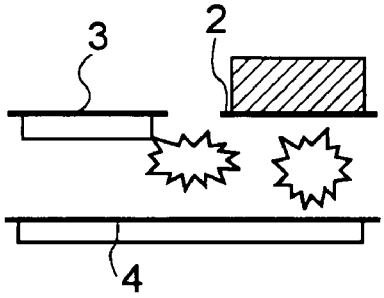
FIG. 21 (6)
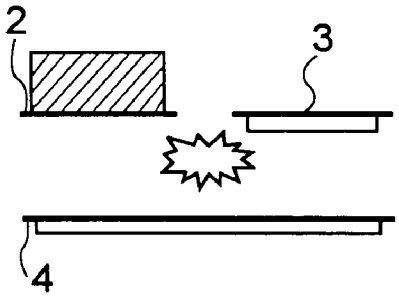

FIG. 23 (1)
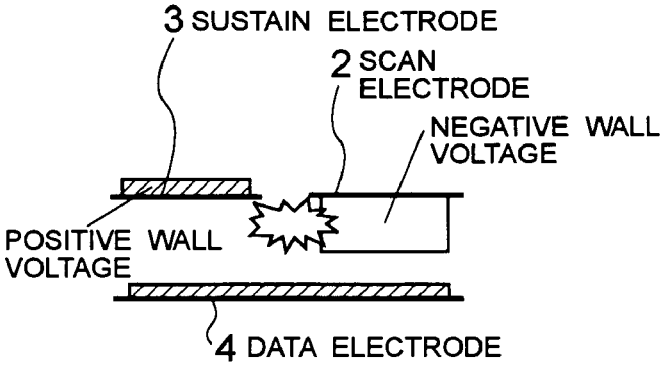
FIG. 23 (2)
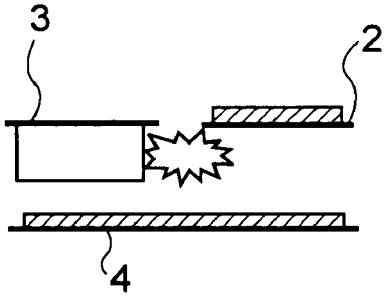
FIG. 23 (3)
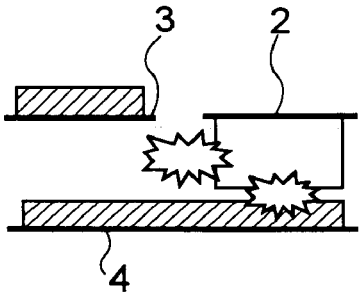
FIG. 23 (4)
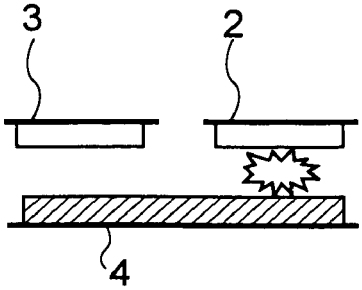
FIG. 23 (5)
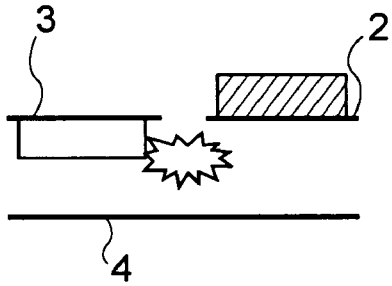
FIG. 23 (6)
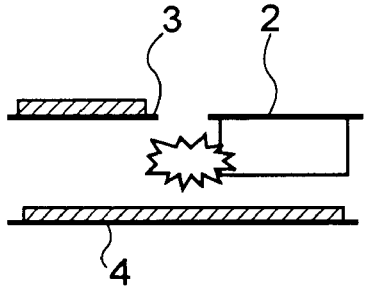

PLASMA DISPLAY DEVICE AND DRIVE METHOD FOR USE IN PLASMA DISPLAY DEVICE

BACKGROUND OF THE INVENTION

1. Field of the Invention

The present invention relates to a plasma display device and a drive method for use in a plasma display device, and more particularly to a plasma display device that can be advantageously used for improving the level of display luminance in a plasma display panel driven by a so-called subfield method and a drive method adapted for such plasma display device. In the subfield method, one field (period) of the display screen is divided into a plurality of subfields weighted based on the gray scale level.

2. Description of the Related Art

Plasma display devices having a plasma display panel (referred to hereinbelow as "PDP") as the main component possess a large number of merits such as a small thickness, comparative easiness of manufacturing a large-screen display, a wide view field angle, and a high response rate. For this reason, the plasma display devices have been widely used in recent years for wall-mounted TV sets and public display devices.

Based on the operation system, such plasma display devices can be classified into several categories. The most popular PDP uses an Address Display-period separate (ADS) drive system such that the scan period, in which the display data are written into cells, and the sustain period, in which the discharge is actually carried out and the display is conducted, are completely separated. With such an Address Display-period separation system, all the display data have been written within the scan period, and then the image display (screen display) is conducted by applying the sustain pulses to all the cells at the same time in the sustain period. Therefore, the internal circuitry can be rather simplified and a drive margin can be ensured because the write discharge for writing the display data into cells and the sustain discharge for causing the display do not exist together in the panel. Because of those advantages, the Address Display-period separate drive system is used in plasma display devices that are presently commercialized.

In plasma display devices of this type, for example, as shown in FIG. 14 of the accompanying drawings, there are provided a surface discharge electrode group and n data electrodes 4 (Dj, j=1, 2, . . . , n). The data electrodes 4 extends perpendicularly to the surface discharge electrode group. The surface discharge electrode group includes m scan electrodes 2 (Scani, i=1, 2, . . . , m) and sustain electrodes 3 (Susi, i=1, 2, . . . , m) disposed parallel to each other in the row direction H of the screen on the inner surface of a front substrate (not shown in the figure) in a display panel 1. The n data electrodes 4 are disposed on the inner surface of a rear substrate (not shown in the figure) along the column direction V. One unit cell 5 (also referred to hereinbelow simply as "cell") is formed in each intersection region of the surface discharge electrode group and data electrodes 4, and a cell group is disposed in the form of a matrix extending in the row direction H and column direction V. In the case of a monochromic display, one cell constitutes one pixel, whereas in the case of a color display, three cells (light-emitting cells of red color R, green color G, and blue color B) constitute one pixel.

FIG. 15 of the accompanying drawings is a cross sectional view of the unit cell 5, taken along the XV-XV line in FIG. 14.

In the unit cell 5, a front substrate 11 and a rear substrate 12 are disposed opposite each other via the prescribed gap. The front substrate 11 is a glass substrate or the like. A scan electrode 2 and a sustain electrode 3 are disposed via a discharge gap 13 on the front substrate 11. A transparent dielectric layer 14 is formed on the scan and sustain electrodes 2 and 3. A protective layer 15 is formed on the transparent dielectric layer 14. The protective layer 15 is composed of MgO or the like, and protects the transparent dielectric layer 14 from discharge. The rear substrate 12 is a glass substrate or the like, and data electrodes 4 are provided on the rear substrate 12 so as to be perpendicular to the scan electrodes 2 and sustain electrodes 3. A white dielectric layer 16 is provided on the data electrodes 4, and a phosphor layer 17 is provided on the white dielectric layer 16. Grid-like barrier ribs 18 are formed, so as to surround each cell, between the front substrate 11 and rear substrate 12. The barrier ribs 18 serve to ensure the discharge space 19 and separate the pixels. A mixed gas of He, Ne, Xe, and the like is enclosed as discharge gas inside the discharge space 19.

FIG. 16 of the accompanying drawings illustrates the principle of the gray scale display method with the Address Display-period separate drive method used in the PDP shown in FIG. 14. Time is plotted against the abscissa and the number of scan electrodes in the PDP is plotted against the ordinate.

In this PDP, as shown in FIG. 16, one field TF is divided into six subfields 1SF, 2SF, . . . , 6SF. Each subfield has its own weighting, depending upon a gray scale level. Each subfield is divided into an initialization period (also called "preliminary discharge period") T1, a scan period T2, and a sustain period T3. The inclined line in each scan period T2 represents the timing of scan pulses applied in linear succession to the scan electrodes 2. If the scan pulses and data pulses that are applied to the data electrodes 4 are applied at the same time, a write discharge is generated. The sustain period T3 is the period in which the unit cell 5 emits a display light.

In the sustain period T3, sustain pulses are alternately applied to the scan electrodes 2 and sustain electrodes 3, and the cells where the discharge is generated in the scan period T2 emit light with an intensity corresponding to the length of the discharge sustain period T3 (thus, to the number of sustain pulses). In FIG. 16, the lengths of sustain periods T3 of the subfields 1SF, 2SF, . . . 6SF are set to ratios of 1:2:4:8:16:32, and therefore a screen with 64 levels (0-63) of gray scale can be displayed by combining the emission triggered within these sustain periods T3. For example, when a screen with the 29th gray scale level is displayed, the control within the interval of one field TF is so conducted that the subfield 1SF (gray scale level 1), subfield 3SF (gray scale level 4), subfield 4SF (gray scale level 8), and subfield 5SF (gray scale level 16) emit light.

FIG. 17 of the accompanying drawings illustrates the main portion of a drive waveform used in the conventional Address Display-period separate drive system, and FIG. 18(1) to FIG. 18(7) illustrate schematically the arrangement of wall voltage on each electrode in the unit cells 5.

The drive method with the Address Display-period separate drive system will be described below with reference to those drawings.

As shown in FIG. 17, a voltage shown on the waveform Sus is applied to the sustain electrode 3 and a voltage shown by a waveform Scan1 and a voltage shown by a waveform Scan2 are applied to the scan electrode 2. In FIG. 17, the drive waveforms applied to the scan electrodes 2 for two display lines are shown. For the third and subsequent display lines, similar drive waveforms are created by successively shifting the scan pulses a in FIG. 17. A voltage shown by a waveform Data is applied to the data electrode 4. FIG. 18(1) to FIG. 18(7) schematically show the size of the wall voltage on each electrode. A white rectangle located below each electrode indicates a negative wall voltage and a gray rectangle located above the electrode indicates a positive wall voltage. The height of each rectangle indicates the value of the wall voltage. The wall voltage is a voltage generated in a dielectric layer by a wall charge formed on the surface of the dielectric layer located on the electrode by the discharge.

Prior to the initialization period T1 shown in FIG. 17, a sustain period of the previous (preceding) subfield is present and the formation amount of the wall charge, which is a charge accumulated by the discharge on the dielectric layers (transparent dielectric layer 14, white dielectric layer 16) located on each electrode in a unit cell 5, differs, depending on whether or not the sustain discharge has been conducted in the sustain period of that previous subfield. As shown in FIG. 18(1), if the write operation is conducted in a state in which the sustain discharge is still conducted in the sustain period of the previous subfield, the write discharge is sometimes difficult to conduct or it is conducted erroneously under the effect of the above-mentioned different amounts of wall charge formed. For this reason, as shown in FIG. 17, in the initialization period T1, a sustain erase waveform b is applied to the scan electrode 2 and the wall charge generated within the sustain period of the previous subfield is initialized (reset).

In this case, only when a sustain discharge is generated in the sustain period of the previous subfield, a weak discharge is generated between the scan electrode 2 and sustain electrode 3, as shown in FIG. 18(2). Because the weak discharge is continuously generated by the application of a ramp waveform with gradually changing voltage like the sustain erase waveform b in FIG. 17, changes in the wall charge on the electrodes caused by the discharge are small. The weak discharge differs from the discharge at which a rectangular waveform is applied, a strong discharge is at once generated, and the polarity of the wall charge on the electrode is at once inverted. As a result, at the end of the sustain period of the previous subfield, the wall voltage arrangement shown in FIG. 18(3) is assumed, changing from the wall voltage arrangement shown in FIG. 18(2).

In the initialization period T1, a priming effect is produced so that a discharge can easily take place when data are written in a linear succession based on the display data in the scan period T2 following the initialization period T1. In the initialization period T1, also, the wall charge state assumes an optimum state for the write discharge. In this case, the priming waveform c and priming erase waveform d are applied to the scan electrode 2. Because of this priming waveform c, a weak discharge is generated, regardless of the generation of the sustain discharge in the previous subfield, and a state is assumed in which the write discharge is easily generated by the appearance of priming particles in the discharge space 19. Further, because of this priming waveform a, the potential of the scan electrode 2 gradually increases in the positive polarity direction with respect to the potential of the data electrode 4, a negative wall charge increases on the scan electrode 2, a positive wall charge increases on the data electrodes 4, and a wall charge arrangement shown in FIG. 18(4) is assumed. At this time, a state in which a write discharge is easily generated is assumed due to the appearance of priming particles and increase in the wall charge. When a no lit condition is continued for a long time in a certain cell, the number of priming particles decreases and the wall charge decreases. Because of the priming waveform a, however, the number of priming particles and wall charge are compensated (increased) with respect to this state.

The wall charge arrangement shown in FIG. 18(4) is adjusted by the priming erase waveform d, so that the correct drive is possible, and becomes the wall charge arrangement shown in FIG. 18(5). Because of the priming erase waveform d, weak discharges are generated between the scan electrode 2 and sustain electrode 3 and between the scan electrode 2 and data electrode 4. Further, because of the priming erase waveform d, the potential of the data electrode 4 is fixed to a ground potential (GND) and the finally attained value of the potential of the scan electrode 2 becomes almost equal to the potential of the scan pulse a. In the final state of the weak discharge, the wall charge is changed by the discharges so that the two electrodes are at potentials which are almost discharge-triggering values but not the discharge-triggering values (i.e., it's close but the discharge is not generated). Therefore, under the effect of the priming erase waveform d, the quantity of wall charge between the scan electrode 2 and data electrode 4 assumes a value at which no discharge is generated unless a data pulse e is applied when the scan pulse a is applied.

As for the state of the wall charge, if even a small positive pulse is applied to the data electrode 4, the discharge is generated, and the write discharge can be generated by even a data pulse e having a low voltage. However, a certain time actually elapses before a discharge is generated after the voltage is applied. Therefore, in order to generate a discharge within a short pulse such as a scan pulse a, the data pulse e is set to a voltage at a level at which this discharge is generated. Thus, in the initialization period T1, an optimum state is set inside the unit cell 5 with respect to the initialization of the wall charge and write discharge.

In the scan period T2, the state of the wall charge is changed and video information is written into the unit cell 5 by the generation or absence of the write discharge for each scan electrode 2 successively in response to the video signals.

Thus, in the scan period T2, the scan pulses a are successively applied to Scan1, Scan2, . . . , Scanm of the scan electrodes 2. The data pulse e is applied according to the display pattern to D1, D2, . . . , Dn of the data electrodes 4 in response to the scan pulses a. The inclined line of the data pulse e in FIG. 17 indicates whether the data pulse e is applied or not applied by the video signal.

The write discharge is conducted as follows. When the data pulse e is applied, the difference in potential between the scan electrode 2 and data electrode 4 is Vd. At this time, in the initialization period T1, as described hereinabove, a negative wall charge and a positive wall charge are formed on the scan electrode 2 and data electrode 4, respectively, and in the discharge space between the scan electrode 2 and data electrode 4, a wall voltage, which is the voltage applied to the dielectric layer due to those wall charges, is superimposed on the potential difference between the electrodes. As a result, a high voltage is applied. Thus, a write discharge is generated between the scan electrode 2 and data electrode 4. At this time, because of a large difference in potential between the scan electrode 2 and sustain electrode 3, if a write discharge is generated between the scan electrode 2 and data electrode 4, a surface discharge is induced between the scan electrode 2 and sustain electrode 3, as shown in FIG. 18(6), and a positive wall charge and a negative wall charge are accumulated on the scan electrode 2 and sustain electrode 3, respectively, as shown in FIG. 18(7). On the other hand, in the pixels to which the data pulse e is not applied, the difference in potential applied to the discharge space between the scan electrode 2 and data electrode 4 does not exceed the discharge start voltage, so that no discharge is generated and the state of the wall charge does not change. Thus wall charge states of two type occur depending on the presence or absence of the data pulse e.

After the scan pulse a has been applied to all the scan electrodes 2, a transition is made to the sustain period T3. In the sustain period T3, the sustain pulse f is alternately applied to all the scan electrodes 2 and all the sustain electrodes 3. The voltage value Vs of the sustain pulse f is so adjusted that the wall voltage in the vicinity of the discharge gap 13 between the scan electrode 2 and sustain electrode 3 is almost equal in the pixels where the write discharge is not generated, and only the Vs, which is the difference in potential between the two electrodes, is applied to the discharge space between the scan electrode 2 and sustain electrode 3. Thus, a surface discharge is not started between the two electrodes. On the other hand, in the pixels where the write discharge is generated, a positive wall charge is present on the scan electrode 2 and a negative wall charge is present on the sustain electrode 3. Therefore, those positive and negative wall charges are superimposed on the initial positive sustain pulse (first sustain pulse) applied to the scan electrode 2, and the voltage equal to or higher than the discharge start voltage is applied to the discharge space. Thus, the sustain discharge is generated. Because of this discharge, a negative wall charge is accumulated on the scan electrode 2 and a positive wall charge is accumulated on the sustain electrode 3. The next sustain pulse (second sustain pulse) is applied to the sustain electrode 3 and the above-described superposition of the wall charges occurs. Thus, the sustain discharge is here also generated and a wall charge of the polarity opposite to that of the first sustain pulse is accumulated on the scan electrode 2 and sustain electrode 3.

Discharges are thereafter continuously generated based on the same principle. In other words, the difference in potential caused by the wall charge induced by the sustain discharge of the x-th cycle is superimposed on the sustain pulse of the (x+1)-th cycle and the sustain discharge is maintained. The luminance of light emission is determined by the number of continuous cycles of the sustain discharge.

The following problems are associated with the Address Display-period separation system.

In the Address Display-period separation system, the light emission discharge for display is conducted only in the sustain period T3, but one field for one screen display is generally fixed to 16.6 msec (1/60 sec). Therefore, when the number of scan lines is high, for example, as in high-resolution displays, the scan period T2 is large and the sustain period T3 shortens correspondingly. If the sustain period T3 becomes shorter, the number of light emission discharges is decreased and the display luminance is reduced.

An Address-While-Display (AWD) drive system is a drive system designed to resolve the above-described problems.

The Address-While-Display drive system uses a PDP of the same structure as that of the Address Display-period separate drive system illustrated by FIGS. 14 and 15, but the scan pulses are applied at the same timing as the sustain pulses. As shown in FIG. 19, one field TF is divided, for example, into six subfields 1SF, 2SF, . . . , 6SF, and one subfield include three pulses: initialization pulse, scan pulse, and sustain pulse. These pulses are applied with a successive shift of the subfields for each scan electrode.

FIG. 20 of the accompanying drawings illustrates the main portion of the drive waveform used in the Address-While-Display drive system.

As shown in FIG. 20, the voltage shown in a waveform Sus is applied to the sustain electrodes 3, and the voltage shown in a waveform Scan1 and the voltage shown in a waveform Scan2 are applied to the scan electrodes 2. FIG. 20 shows the scan electrodes 2 for two display lines only. Similar drive waveforms are applied to the third and subsequent display lines, with a successive shift of scan pulses a. A voltage shown on the waveform Data is applied to the data electrode 4.

FIG. 21(1) to FIG. 21(6) of the accompanying drawings are a series of schematic drawings illustrating the size of the wall voltage on each electrode in the Address-While-Display drive system.

The drive method with the Address-While-Display drive system will be described below with reference to FIG. 21(1) to FIG. 21(6) as well as FIG. 20.

FIG. 21(1) to FIG. 21(6) show the wall voltage in a cell at the six different timing when the Scan1 waveform shown in FIG. 20 is applied to the cell at the timing (1) to (6) in FIG. 20.

As shown in FIG. 20, a pulse of a negative polarity immediately preceding the initialization pulse g is the very last sustain pulse f of the previous subfield, and the very last sustain pulse f is applied at the timing (1). When a sustain discharge is generated in the previous subfield, a sustain discharge is also generated between the scan electrode 2 and sustain electrode 3 at the timing (1) and the wall voltage arrangement changes from the state shown in FIG. 21(1) to that shown in FIG. 21(2).

Then, the initialization pulse g is applied. The state of the wall charge in the unit cell 5 before the initialization pulse g differs depending on whether or not a sustain discharge is generated in the previous subfield. Thus, if the write operation is conducted in a state in which a sustain discharge is generated in the previous subfield, then the write discharge is sometimes difficult to conduct or the writing is conducted erroneously under the effect of this different wall charge. The role of the initialization pulse g is to initialize a state of the wall charge on the dielectric layer in the unit cell 5 that differs depending on the presence or absence of the sustain discharge in the previous subfield. At the timing (2), a sustain pulse f is applied to the sustain electrode 3 at the same time as the initialization pulse g is applied to the scan electrode 2. As a result, a voltage larger than the voltage created upon application of the preceding sustain pulse f is applied between the scan electrode 2 and sustain electrode 3, and a surface discharge is generated between the two electrodes. Then, as shown in FIG. 21(3), wall voltages larger than those during the usual sustain discharge are formed on both the scan electrode 2 and sustain electrode 3.

In the case where only the usual sustain pulse f is then applied, the discharge is not generated during a rise at the pulse end. However, a large wall voltage is formed due to the application of the initialization pulse g. Thus, when both the scan electrode 2 and sustain electrode 3 assume a ground (GND) potential at the end point of the sustain pulse f and initialization pulse g, a voltage equal to or higher than the discharge start voltage is applied by the wall voltage to the discharge space 19 and the surface discharge is generated again. At this time, all the electrodes, including the data electrode 4, are at the GND potential. Therefore, after the discharge end, as shown in FIG. 21(4), the wall voltage is almost absent. In this state, the initiation ends.

Then, a scan pulse a is applied to the scan electrode 2 and writing is conducted. In this writing, the state of wall charges is changed in response to the video signal depending on the presence or absence of the write discharge generation and the video information is written into the unit cell 5 successively for each scan electrode 2. In this case, at the timing (4) shown in FIG. 20, the data pulse e is applied according to the video signal to the data electrode 4 synchronously with the scan pulse a. The inclined line in the data pulse e indicates whether or not the data pulse e is applied, based on the video signals. If the data pulse e is applied, a high voltage exceeding the discharge start voltage is applied between the scan electrode 2 and data electrode 4 and, as shown in FIG. 21(4), an oppositely directed discharge is generated between the two electrodes. At this time, a large difference in potential is also present between the scan electrode 2 and sustain electrode 3, so that if a write discharge is generated between the scan electrode 2 and data electrode 4, a surface discharge is induced between the scan electrode 2 and sustain electrode 3 and, as shown in FIG. 21(5), a positive wall charge is accumulated on the scan electrode 2 and a negative wall charge is accumulated on the sustain electrode 3.

On the other hand, in the cell to which the data pulse e is not applied, the difference in potential that is applied to the discharge space between the scan electrode 2 and data electrode 4 does not exceed the discharge start voltage. Therefore, no discharge is generated and the state of wall charge does not change. Thus, the states of wall charges of two types can be produced depending on whether the data pulse e is present or absent. At this time, the scan pulse a is applied at the same timing as the sustain pulse f is applied to the other scan electrode. For example, at the timing (6) shown in FIG. 20, a sustain pulse f shown on the waveform Scan1 is applied and a scan pulse a shown on the waveform Scan2 is applied. Writing has to be conducted for each scan electrode. Thus, even if the scan pulse a and sustain pulse f are applied at the same timing, the write discharge has to be generated only with the scan electrode to which the scan pulse a is applied. For this reason, the voltage Vw of the scan pulse a is set to a value with a negative polarity greater than that of the sustain voltage Vs. Due to the increase in the voltage, write discharge is generated only at the scan electrode to which the scan pulse a is applied. However, in the case where the data pulse e is not applied, the generation of discharge has to be prevented. Therefore, the voltage Vw of the scan pulse a cannot be set to a value over the discharge start voltage between the scan electrode 2 and sustain electrode 3.

The pulse width of the scan pulse a is wider than the sustain pulse f and ends at the timing (5) the next sustain pulse f is applied to the sustain electrode 3. At the timing (5), if the scan pulse a rises, the data pulse e also ends at the same time, and a write discharge is generated, then a discharge in the opposite direction is generated between the scan electrode 2 and data electrode 4 by the wall voltage formed upon this write discharge. Separately therefrom, because the sustain pulse f is applied to the sustain electrode 3, a discharge is also generated between the scan electrode 2 and sustain electrode 3. As a result, the wall voltage arrangement changes from the state shown in FIG. 21(5) to that shown in FIG. 21(6). Then, the surface discharge is generated each time the sustain pulse f is applied, and the wall voltage arrangement states shown in FIG. 21(5) and FIG. 21(6) are alternately repeated.

On the other hand, when the data pulse e is not applied and the write discharge is not generated, the wall voltage remains in the state shown in FIG. 21(4), and no discharge is thereafter generated even if the sustain pulse f is applied. As described hereinabove, the states with and without the generation of the sustain discharge can be switched by applying or not applying the data pulse e. In such an Address-While-Display drive system, the scan pulse a can be superimposed in time on the sustain pulse f. Therefore, the interval in which the scan pulse a is applied to the other scan electrode can be allocated to the sustain discharge generation interval. As a consequence, all the pulses other than the initialization pulse g and scan pulse a of the scan electrode can be allocated to the application interval of the sustain pulse f. Furthermore, a major portion of one field can be allocated to the sustain period. Therefore, the display luminance level is increased by increasing the number of sustain pulses.

FIG. 22 illustrates the main portion of the drive waveform used in another Address-While-Display drive system.

In the drive method with this Address-While-Display drive system, as shown in FIG. 22, the sustain pulse f assumes a positive polarity. Furthermore, the initialization pulses h, j are successively applied to the scan electrode 2. The initialization pulse h is larger than the voltage Vs of the sustain pulse. When a scan pulse a is applied, other scan electrodes may be at a GND potential, and therefore a potential has to be decreased below the GND potential in order to generate the write discharge only with the scan electrode to which the scan pulse a is applied. However, similar to the case of the drive waveform shown in FIG. 20, the surface discharge must not be generated between the scan electrode 2 and sustain electrode 3 merely by introducing the scan pulse a. Therefore, the sum of the voltage Vs of the sustain pulse f and the voltage Vw of the scan pulse a cannot be set so as to exceed the discharge start voltage. The states of the wall voltage at timings (1) to (6) in FIG. 22 are shown in FIGS. 23(1) to 23(6), respectively.

In addition to the above-described drive systems, there is a scan-sustain mix drive system. One example of the scan-sustain mix drive systems is a drive method for a gas discharge panel disclosed in Japanese Patent Kokai (Laid-open Application No. 2000-122603 (Abstract and FIG. 4). With the drive method described in Japanese Patent Kokai No. 2000-122603, a scan pulse is applied between a certain sustain pulse and another sustain pulse, so as to avoid overlapping in time. In this case, because the scan pulse and sustain pulse are not applied at the same timing, the write discharge is generated only at the scan electrode to which a scan pulse is applied.

In the display device described in Japanese Patent Application Kokai No. 2000-112430 (Abstract and FIG. 3), a drive method is employed that is similar to that described in Japanese Patent Kokai No. 2000-122603.

The following problems are associated with the above-described conventional plasma display devices.

With the Address-While-Display drive system, the major portion of the one field interval is allocated to the sustain discharge and a high display luminance is obtained. However, because the scan pulse a is applied at the timing the sustain pulse f is applied to the other scan electrode, a voltage larger than the sustain pulse f has to be applied so that the write discharge is generated only at the scan electrode to which the scan pulse a has been applied. In other words, a voltage Vw of the scan pulse has to be set in addition to the voltage Vs of the sustain pulse f. Therefore, it is necessary to set more voltages than in the case of Address Display-period separate drive system, the scale of the power source circuit is increased, and the scale of the scan electrode drive circuit (not shown in the figure) is also increased. Furthermore, as shown in FIG. 20, the voltage Vw of the scan pulse is a negative voltage greater than the voltage Vs of the sustain pulse and has to be set to a voltage at which no discharge is generated when the data pulse e is not applied. Also, the voltage Vs of the sustain pulse has to be a relatively large value so that the sustain discharge continues each time the potential is inverted. Thus, the range of the voltage Vw of the scan pulse is significantly narrowed and the drive margin cannot be widened.

In the case shown in FIG. 22, too, the level of the scan pulse a is such that the potential difference (Vw) from the GND level is less than the scan pulse voltage Vw shown in FIG. 20, but the initialization pulse h becomes a positive voltage larger than the voltage Vs of the sustain pulse. Similar to the scan pulse a, the initialization pulse h is also supplied in a linear succession to each scan electrode, so that the output from the scan electrode drive circuit is necessary, and the scan electrode drive circuit has to withstand the voltage of the initialization pulse h. In either of the cases illustrated by FIG. 20 and FIG. 22, both application of the data pulse e and application of the scan pulse a should be required to generate the discharge; it is necessary to prevent the surface discharge from generating between the scan electrode 2 and sustain electrode 3 when the scan pulse a is only applied. For this purpose, it is necessary to prevent the difference in potential between the scan electrode 2 and sustain electrode 3 from exceeding the discharge start voltage of the surface when scan pulses a are applied.

On the other hand, in order to conduct writing with scan electrodes to which scan pulses a are applied, the potential of the scan pulse a has to be lower than the potential of other scan electrodes. As a result, it is necessary to apply a voltage equal to or higher than the voltage of the sustain pulse between the scan electrode 2 and sustain electrode 3. The voltage of the sustain pulse has to be sufficiently high so as to maintain the sustain pulse. Thus, voltage setting of the scan pulse a can be conducted only within a certain limited range, which results in a narrowed drive margin.

With the scan-sustain mix drive system described in Japanese Patent Kokai Nos. 2000-122603 and 2000-112430, the sustain pulse and scan pulse overlap in time. Therefore, the number of sustain pulses in one field is equal to that of the Address Display-period separate drive system and the luminance level is difficult to increase, as in the Address-While-Display drive system.

SUMMARY OF THE INVENTION

According to a first aspect of the present invention, there is provided a plasma display device which includes a plasma display panel and a drive unit for driving the plasma display panel. One field of display period is divided into a plurality of subfields, and the subfields are weighted based on a gray scale level. The drive unit operates the plasma display device on the basis of a so-called subfield method. The plasma display panel has a first substrate and a second substrate disposed opposite each other. The plasma display panel also has a plurality of sustain electrode pairs. Each sustain electrode pair has a first sustain electrode and a second sustain electrode disposed parallel to each other with a first discharge gap therebetween on the surface of the first substrate. This face of the first substrate faces the second substrate. Each sustain electrode pair generates a sustain discharge upon application of a sustain pulse. The plasma display panel also has a plurality of scan electrodes disposed parallel to the sustain electrode pairs with a second discharge gap therefrom on the surface of the first substrate. This surface of the first substrate faces the second substrate. The scan pulses are successively applied to the scan electrodes for conducting write discharge according to video signals. The plasma display panel also has a plurality of data electrodes provided in a pattern crossing each sustain electrode pair on the surface of the second substrate that faces the first substrate. The plasma display panel also has a plurality of unit cells formed in intersection regions of the sustain electrode pairs and the data electrodes. The plasma display panel also has a first dielectric layer covering the sustain electrode pairs and scan electrodes. The plasma display panel also has a second dielectric layer covering the data electrodes. The drive unit is configured to conduct for each subfield the Address-While-Display drive in which the scan pulses are applied at the same timing as the sustain pulses. A wall voltage is generated by a wall charge formed on the first dielectric layer located on the scan electrodes when the scan pulses are applied to the scan electrodes. The drive unit makes this wall voltage higher in the negative voltage direction than the wall voltage generated by a wall charge formed on the first dielectric layer located on the sustain electrode pairs.

It is preferred that, for each subfield, the ratio of the weight of the subfield concerned, to the weight of an adjacent subfield with a weight less than that of that subfield be set to about 2:1.

It is preferred that the drive unit be configured to apply to the scan electrodes an erase pulse of a negative polarity for initializing the wall charge after the sustain discharge has been generated, to cause the generation of an erase discharge at the timing of a rise when the erase pulse ends, and to set the potential of the scan electrodes during generation of the erase discharge higher than the potential of the sustain electrode pair.

It is preferred that the drive unit be configured to set identical potentials of the first and second sustain electrodes during the generation of the erase discharge.

It is preferred that the drive unit be configured to generate the erase discharge between the scan electrode and one of the two sustain electrodes in the sustain electrode pair which is closer to the scan electrode. This sustain electrode is referred to as a "closer sustain electrode."

It is preferred that the drive unit be configured to generate a preliminary erase discharge in the opposite direction between the scan electrode and the data electrode by applying an erase data pulse to the data electrode at the same timing as the application of the erase pulse.

It is preferred that the drive unit be configured to apply the erase pulse so that the potential of the scan electrode differs from the potential of the closer sustain electrode of the sustain electrode pair when the sustain pulse of positive polarity is applied to the closer sustain electrode.

It is preferred that the drive unit be configured to apply the scan pulse so that the potential of the scan electrode differ from the potential of the closer sustain electrode of the sustain electrode pair when the sustain pulse of positive polarity is applied to the closer sustain electrode.

It is preferred that the drive unit be configured to alternate the sustain electrodes of the sustain electrode pair to which the sustain pulse is applied, while the scan pulse is being applied, and to end the scan pulse after the sustain discharge is generated in the sustain electrode pair.

It is preferred that the drive unit be configured to end the scan pulse, while the sustain pulse is being applied to the sustain electrode of the sustain electrode pair which is initially alternated, when the scan pulse is applied and a write discharge is generated.

It is preferred that the drive unit be configured to equalize the potential of the scan electrode obtained when the scan pulse is applied and the potential of the sustain electrode pair obtained when the sustain pulse is not applied.

The drive unit may be configured to apply only a sustain pulse to the sustain electrode pair.

The drive unit may be configured to apply the erase data pulse only when the write discharge is conducted by the immediately preceding scan pulse and the sustain discharge is generated.

The drive unit may be configured to apply the erase data pulse at prescribed timing, regardless of a display image.

The drive unit may be configured to apply a ramp waveform to the scan electrode at prescribed timing, regardless of a display image.

The drive unit may be configured to set the voltage of the data pulse corresponding to the video signal applied to the data electrode synchronously with the scan pulse the same as the voltage of the erase data pulse.

The plasma display panel may have a light shielding layer on the panel display screen side of each second discharge gap and each scan electrode.

The plasma display panel may be configured so that each of the sustain electrode pairs and each of the data electrodes are not disposed opposite each other, with the first and second dielectric layer therebetween.

In accordance with a second aspect of the present invention, there is provided a drive method for a plasma display device. This drive method is suitable for a plasma display device which includes a plasma display panel and a drive unit for driving the plasma display panel on the basis of a subfield method. In the subfield method, one field of a display screen is divided into a plurality of subfields weighted based on gray scale levels. The plasma display panel has a first substrate and a second substrate disposed opposite each other, and a plurality of sustain electrode pairs. Each sustain electrode pair has a first sustain electrode and a second sustain electrode disposed parallel to each other with a first discharge gap therebetween on the surface of the first substrate that faces the second substrate. Each sustain electrode pair generates a sustain discharge upon application of a sustain pulse. The plasma display panel also has a plurality of scan electrodes disposed parallel to the sustain electrode pairs with a second discharge gap therefrom on the surface of the first substrate that faces the second substrate. The scan pulses for conducting write discharge according to video signals are successively applied to the scan electrodes. The plasma display panel also has a plurality of data electrodes provided in a pattern crossing each sustain electrode pair on the surface of the second substrate that faces the first substrate, a plurality of unit cells formed in intersection regions of the sustain electrode pairs and data electrodes, a first dielectric layer covering the sustain electrode pairs and scan electrodes, and a second dielectric layer covering the data electrodes. The drive unit conducts for each subfield the Address-While-Display drive in which the scan pulses are applied at the same timing as the sustain pulses. A wall voltage is generated by a wall charge formed on the first dielectric layer located on the scan electrode when the scan pulse is applied to the scan electrode. The drive unit makes this wall voltage higher in the negative voltage direction than the wall voltage generated by a wall charge formed on the first dielectric layer located on the sustain electrode pair.

With the present invention, the PDP has the scan electrodes separately in addition to the sustain electrode pairs for generating a sustain discharge, and the drive unit is configured to conduct for each the subfield the Address-While-Display drive and to set a wall voltage generated by a wall charge formed on the first dielectric layer located on the scan electrode higher in the negative voltage direction than the wall voltage generated by a wall charge formed on the first dielectric layer located on the sustain electrode pair when the scan pulse is applied to the scan electrode. Therefore, the display gray scale level can be increased and a wide drive margin is obtained without the necessity to increase the scale of the power source circuit.

Because the PDP has a configuration in which each sustain electrode pair and data electrode are not disposed opposite each other over the first and second dielectric layers, the intensity and spread of the sustain discharge are almost unaffected by fluctuations in the data electrode potential. Therefore, the emission luminance is not changed and luminance irregularities on the display screen can be avoided.

BRIEF DESCRIPTION OF THE DRAWINGS

FIG. 7(1) to FIG. 7(8) are a series of views showing a wall voltage in the unit cell;

FIG. 11(1) to FIG. 11(7) show a wall voltage arrangement in a unit cell, respectively;

FIG. 18(1) to FIG. 18(7) is a series of schematic diagrams illustrating the arrangement of wall voltage on electrodes in the unit cell;

FIG. 21(1) to FIG. 21(6) are a series of schematic diagrams illustrating the size of the wall voltage on the respective electrodes in the Address-While-Display drive system;

FIG. 23(1) to FIG. 23(6) are a series of schematic diagrams illustrating the size of the wall voltage on electrodes in the Address-While-Display drive system shown in FIG. 21(1) to FIG. 21(6).

DETAILED DESCRIPTION OF THE INVENTION

Figure 1:
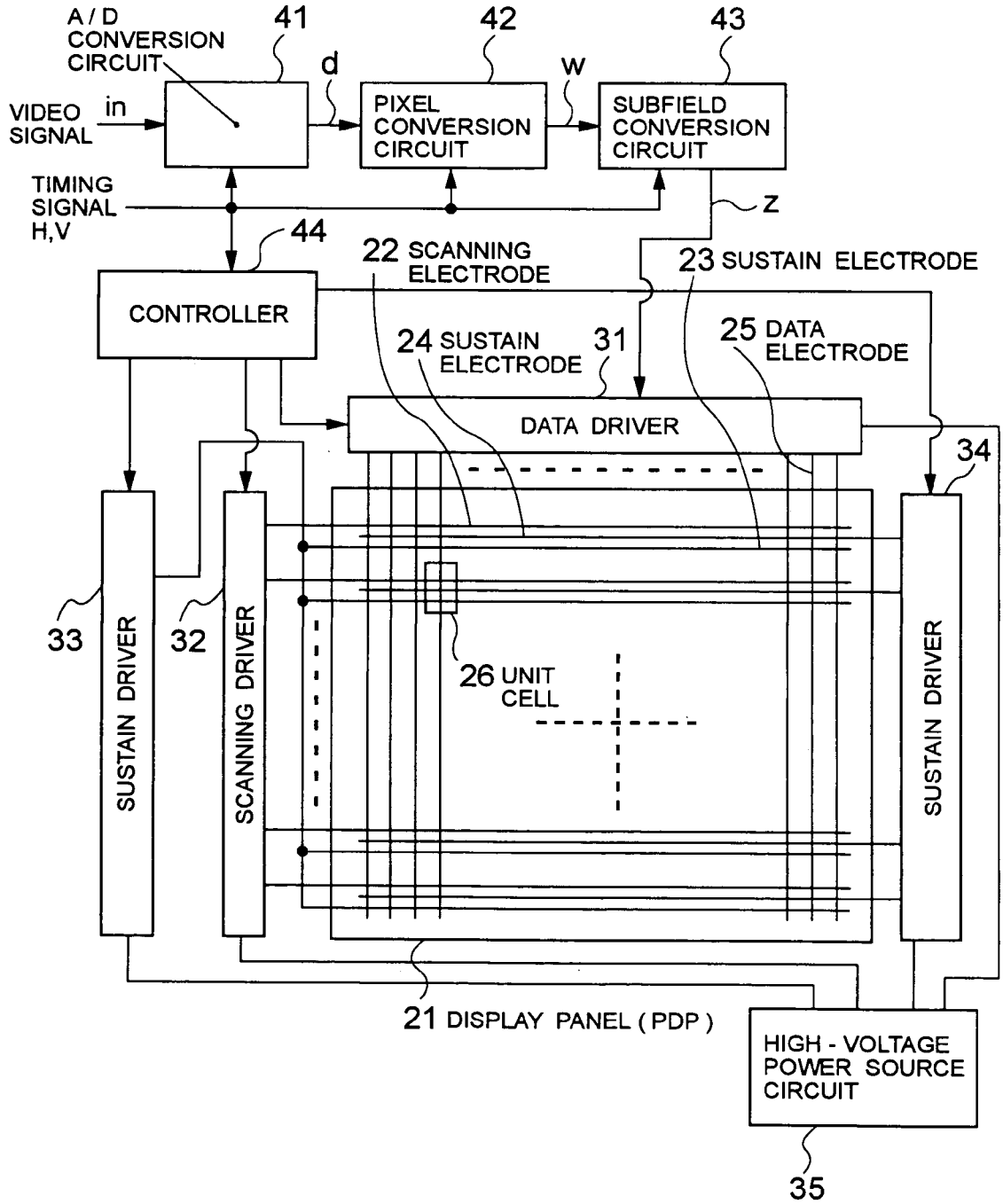
FIG. 1 is a block diagram illustrating an electric configuration of the plasma display device of a first embodiment of the present invention.

Referring to FIG. 1, a configuration of the plasma display device of a first embodiment of the present invention will be described.

The plasma display device of this embodiment includes a display panel (PDP) 21, a data driver 31, a scanning driver 32, a sustain driver 33, another sustain driver 34, a high-voltage power source circuit 35, an A/D (analog/digital) conversion circuit 41, a pixel conversion circuit 42, a subfield conversion circuit 43, and a controller 44. The display panel 21 has a front substrate and a rear substrate (not shown in the figure) that are disposed opposite each other. On the inside surface of the front substrate (i.e., the surface which faces the rear substrate), a plurality of first sustain electrodes 23 and second sustain electrodes 24 are provided parallel to each other via discharge gaps (not shown in the figure). Each first sustain electrode 23 and second sustain electrode 24 form a sustain electrode pair and generate a sustain discharge upon application of sustain pulses. The wiring terminals of the first sustain electrodes 23 are lead out from the left side of the display panel 21, and the wiring terminals of the second sustain electrodes 24 are lead out from the right side of the display panel 21. Such a configuration is chosen for the following reason. If the wiring terminals of the first sustain electrodes 23 and second sustain electrodes 24 are lead out from the same side of the display panel 21, the unit cells of the final stage on the opposite side where no terminals are led out are at the largest distance from both the sustain driver 33 and the sustain driver 34 and the voltage drop of sustain pulses becomes significant. As a result, in unit cells in certain positions, the display luminance becomes irregular. On the surface of the front substrate that faces the rear substrate (this surface may be called the "inner surfaces" or "first surface" of the front substrate), there are provided a plurality of scan electrodes 22 via discharge gaps (not shown in the figure) that are parallel to the sustain electrode pairs, and scan pulses for write discharge are successively applied to the scan electrodes 22. On the surface of the rear substrate that faces the front substrate (this surface may be called the "inner surface" or "first surface" of the rear substrate), there are provided a plurality of data electrodes 25 in a pattern crossing the sustain electrodes, and data pulses and erase data pulses are applied to the data electrodes 25. Unit cells 26 are formed in the intersection regions of the sustain electrode pairs and data electrodes 25.

The data driver 31 applies data pulses corresponding to display data z and erase data pulses to the data electrodes 25. The scan driver 32 applies scan pulses and erase pulses to the scan electrodes 22. The sustain drivers 33 and 34 apply sustain pulses to the first sustain electrodes 23 and second sustain electrodes 24, respectively. The high-voltage power source circuit 35 supplies a prescribed high-voltage power to the data driver 31, scan driver 32, and sustain drivers 33 and 34. The A/D conversion circuit 41 converts an analog video signal "in" into digital video signal d. The pixel conversion circuit 42 converts the number of pixels of the video signal d into the number of pixels of the display panel (PDP) 21, which is the number of pixels that is actually displayed, and generates a video signal w. The subfield conversion circuit 43 converts the video signal w from the pixel conversion circuit 42 into display data z for each subfield and sends it to the data driver 31. The controller 44 controls the operation timing of the data driver 31, scan driver 32, and sustain drivers 33, 34 and controls the input of the voltage generated by the high-voltage power source circuit 35. In particular, in the present embodiment, the controller 44 conducts for each subfield an Address-While-Display drive such that the scan pulses are applied at the same timing as the sustain pulses. The timing signals (horizontal synchronization signal, vertical synchronization signal) H, V are introduced into the A/D conversion circuit 41, pixel conversion circuit 42, subfield conversion circuit 43, and controller 44 to synchronize the operation thereof with the display screens (displayed images).

Figure 2:
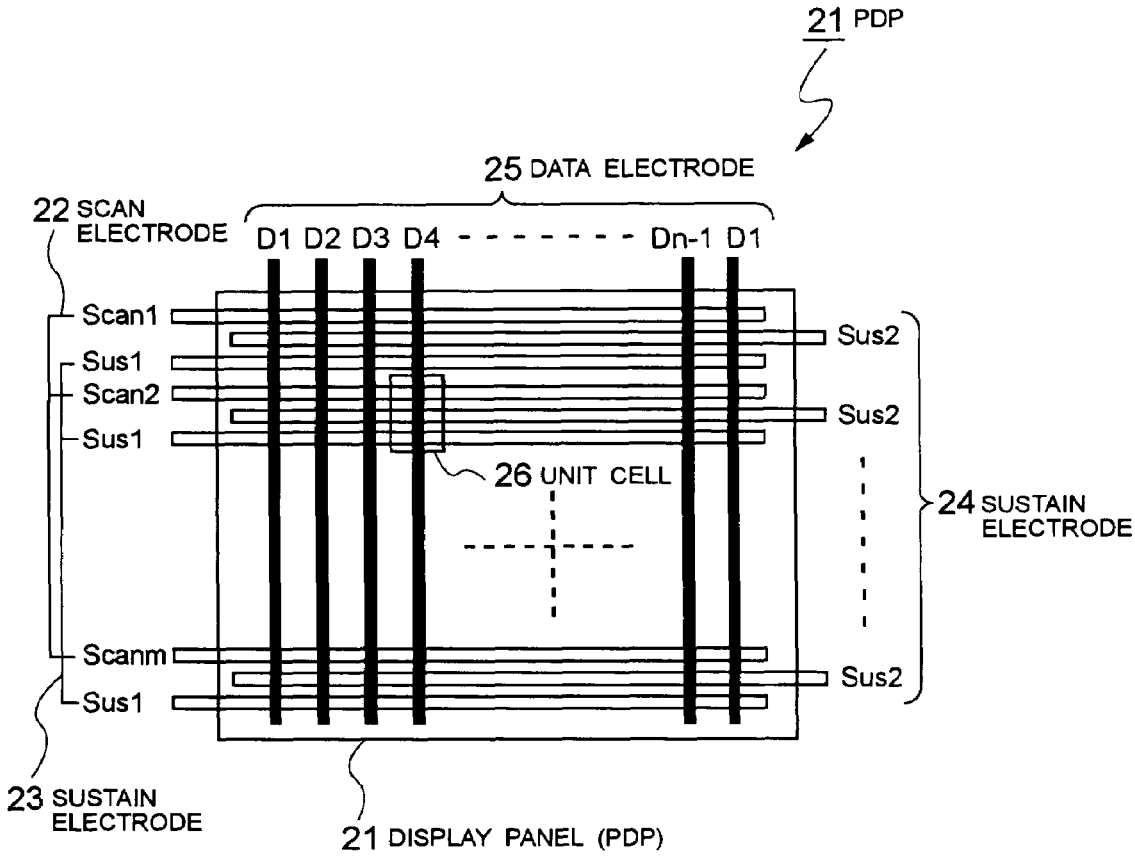
FIG. 2 is a structural diagram of the PDP shown in FIG. 1.

FIG. 2 is a structural diagram of the PDP 21 shown in FIG. 1.

In this PDP 21, as shown in FIG. 2, the scan electrodes 22 are composed of electrodes Scani (i=1, 2, . . . , m), the first sustain electrodes 23 are composed of electrodes Sus1, the second sustain electrodes 24 are composed of electrodes Sus2, and the data electrodes 25 are composed of electrodes D1, D2, . . . Dn.

Figure 3:
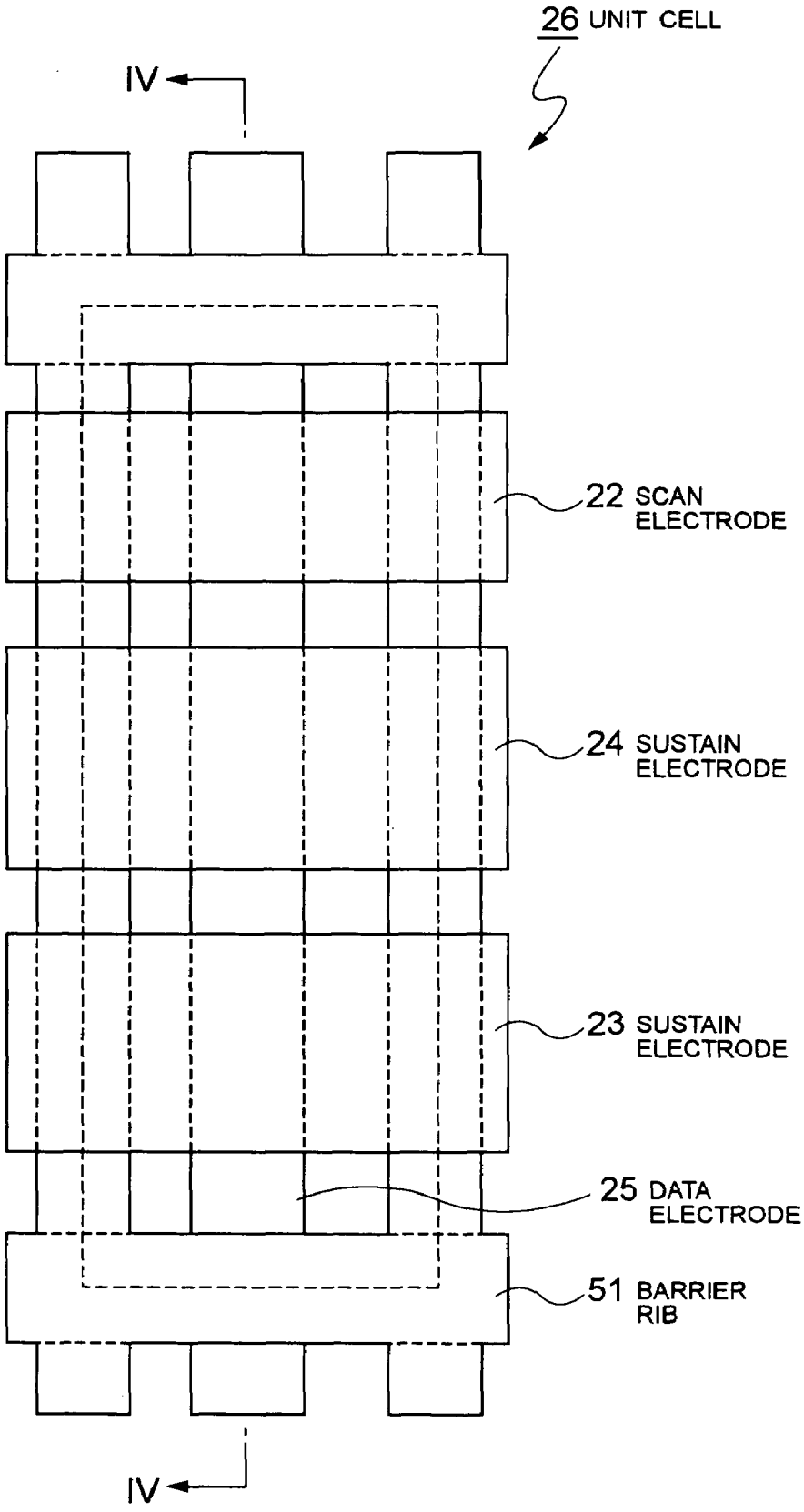
FIG. 3 is an enlarged plan view of a unit cell shown in FIG. 2.

FIG. 3 is an enlarged plan view of the unit cell 26 shown in FIG. 2.

In the unit cell 26, as shown in FIG. 3, the scan electrode 22, first sustain electrode 23, and second sustain electrode 24 are disposed above the barrier rib 51, and the data electrode 25 is disposed below the barrier rib 51.

Figure 4:
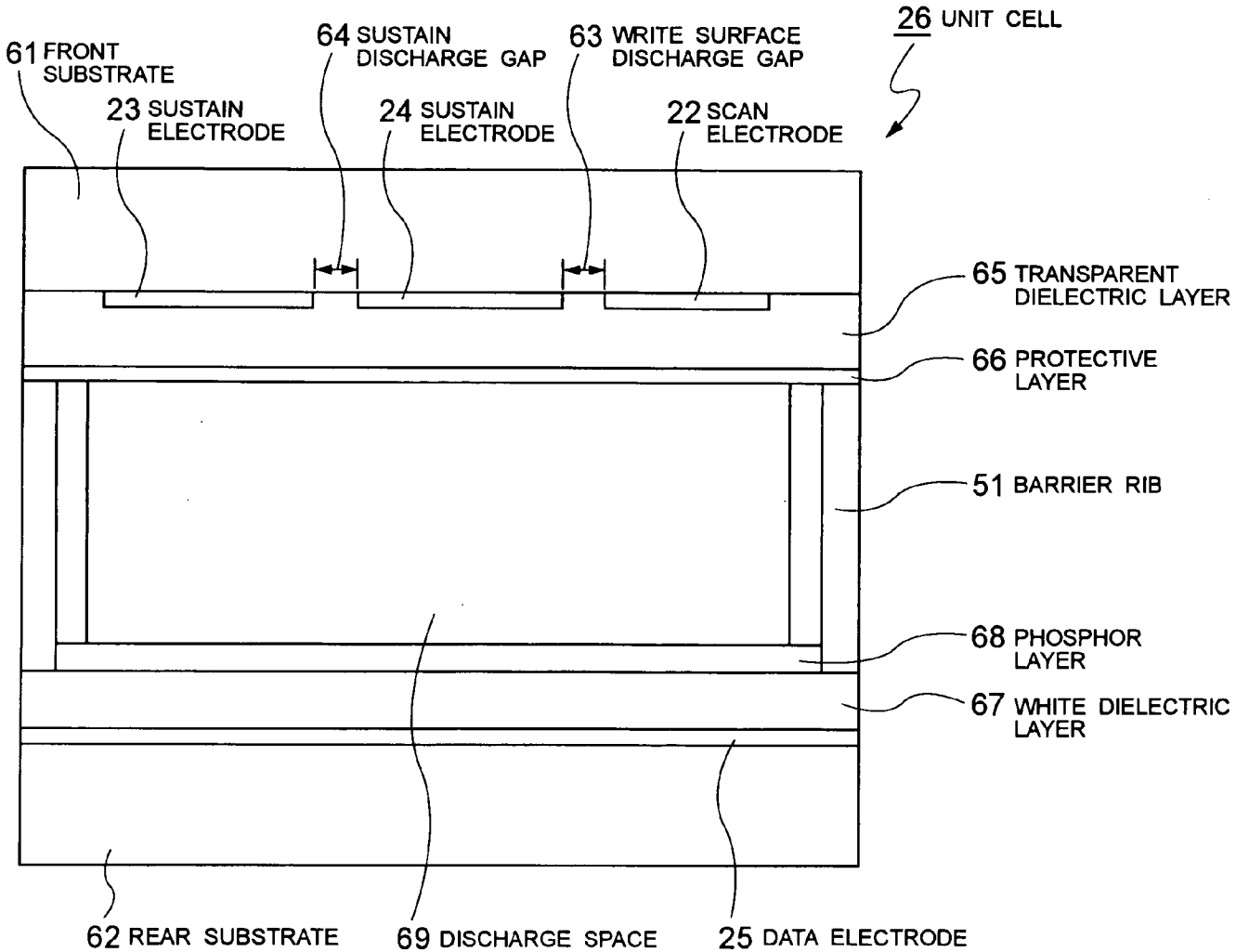
FIG. 4 is a cross-sectional view of the unit cell, taken along the IV-IV line shown in FIG. 3.

FIG. 4 is a cross-sectional view along the IV-IV line of the unit cell 26 shown in FIG. 3.

In the unit cell 26, as shown in FIG. 4, a front substrate 61 and a rear substrate 62 are disposed opposite each other via a prescribed gap. The front substrate 61 is a glass substrate or the like. On the front substrate 61, the scan electrodes 22 and second sustain electrodes 24 are disposed via a write surface discharge gap 63, and the second sustain electrodes 24 and first sustain electrodes 23 are disposed via a sustain gap 64. A transparent dielectric layer 65 is formed so as to cover these electrodes, and a protective layer 66 is formed on the transparent dielectric layer 65. The protective layer 66 is formed from MgO or the like and protects the transparent dielectric layer 65 from electric discharge. The first sustain electrode 23 and second sustain electrode 24 serving as a sustain electrode pair are transparent electrodes made from ITO (Indium Tin Oxide, transparent conductive thin film) or the like because they have to generate a sustain discharge and to provide the light used for display. The scan electrodes 22 are not required to be transparent electrodes because they generate a discharge for write, erase, and initialization and conduct no discharge for the display. Rather, because the discharge for initialization that is not related to the display increases the black display luminance, an undesirable decrease in contrast is induced. Therefore it is preferred that light be shielded, for example, by fabricating the scan electrodes 22 from metal electrodes. When the scan electrodes 22 are fabricated from metal electrodes, the electrode resistance can be reduced and voltage drop caused by the discharge current is decreased. On the other hand, the rear substrate 62 is formed from a glass substrate or the like, and the data electrodes 25 are provided on the rear substrate 62 so as to cross the scan electrodes 22 and sustain electrodes 23, 24 at a right angle. Moreover, a white dielectric layer 67 is provided so as to cover the data electrodes 25, and a phosphor layer 68 is provided on the white dielectric layer 67. Grid-like barrier ribs 51 are formed, so as to surround each cell, between the front substrate 61 and rear substrate 62. The barrier ribs 51 serve to ensure the discharge space 69 and separate the pixels. A mixed gas of He, Ne, Xe, and the like is enclosed as discharge gas inside the discharge space 69.

Figure 5:
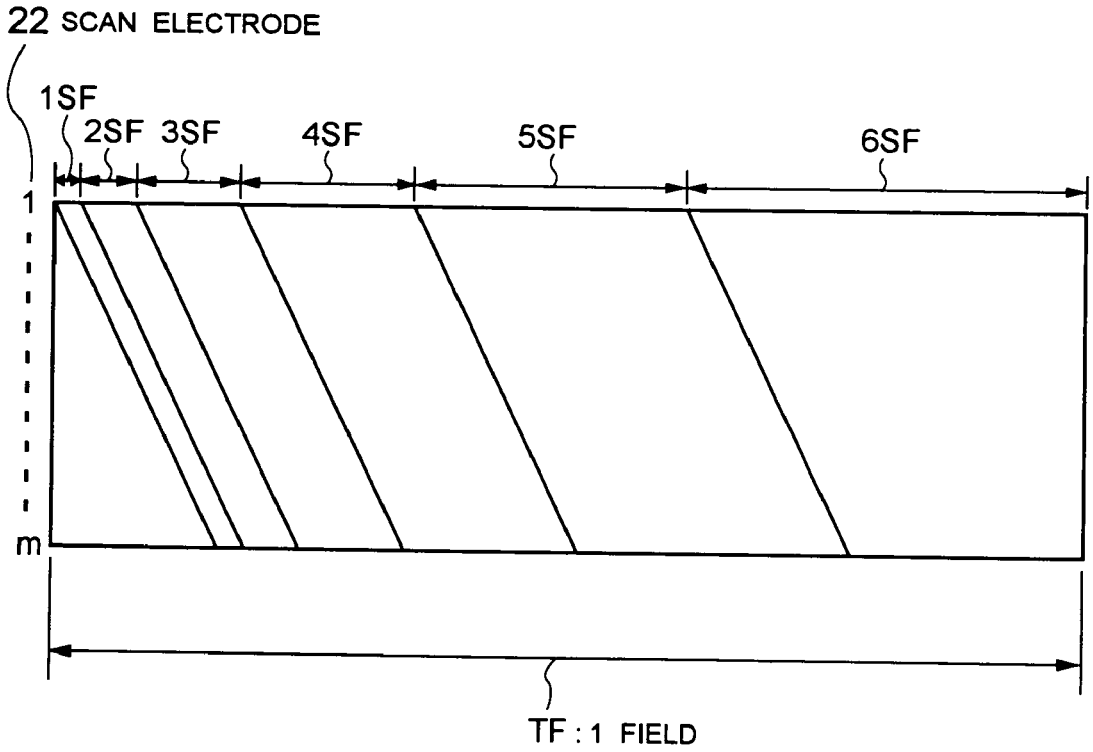
FIG. 5 illustrates the configuration of one field.
Figure 6:
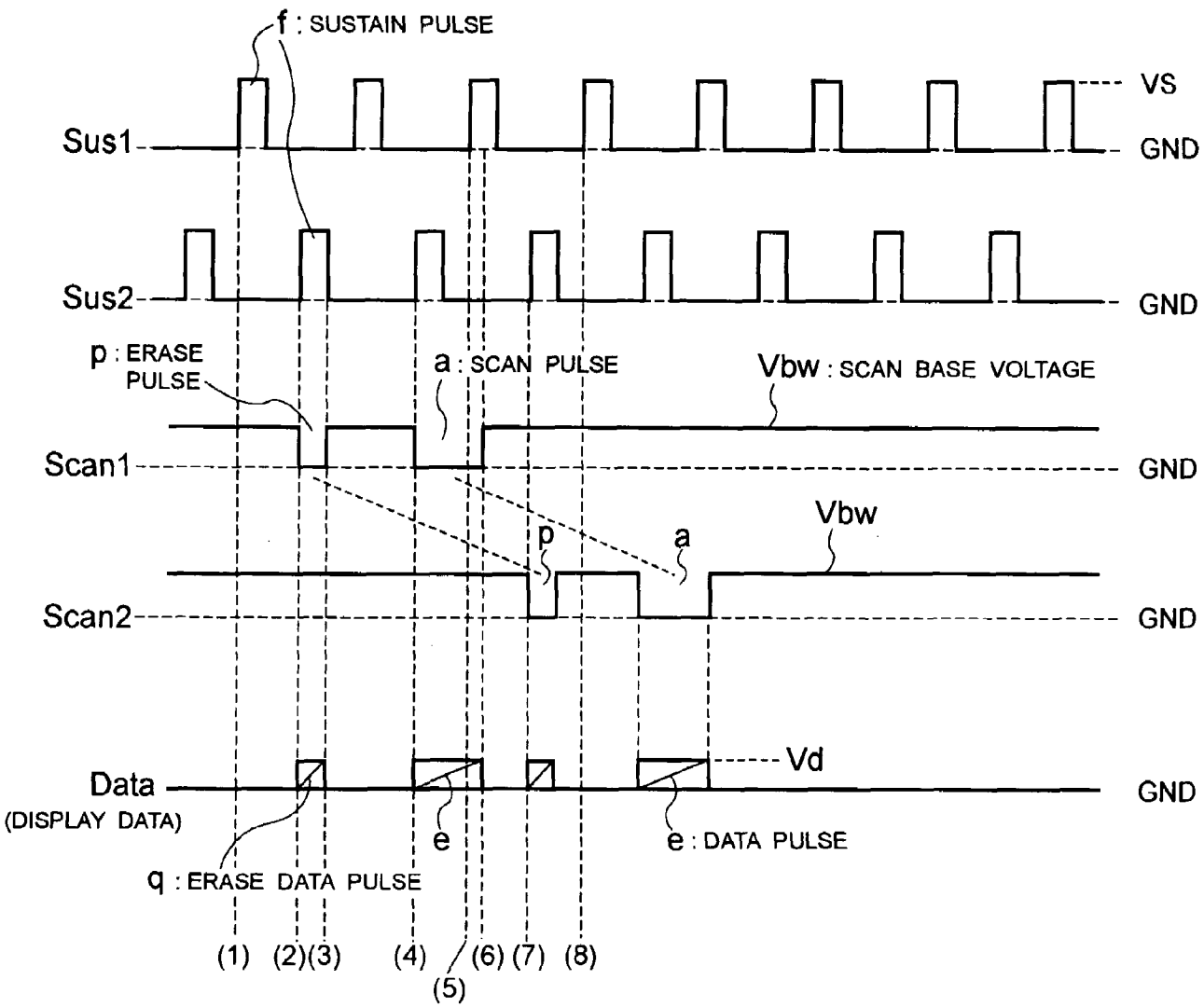
FIG. 6 illustrates some drive waveforms in one subfield shown in FIG. 5.

FIG. 5 illustrates the configuration of one field TF. FIG. 6 illustrates part of the drive waveforms in one subfield shown in FIG. 5. FIG. 7(1) to FIG. 7(8) show a wall voltage arrangement in the unit cell 26, respectively.

The processing performed in the plasma display device drive method of this embodiment will be described below with reference to those drawings.

With the drive method of this embodiment, the scan pulses are applied at the same timing as the sustain pulses and, as shown in FIG. 5, one field TF is divided, for example, into six subfields 1SF, 2SF, . . . , 6SF. One subfield has pulses of three types: initialization pulse, scan pulse, and sustain pulse. These pulses are applied to each scan electrode 22 in the mode with successive shifting of subfields. An inclined line of the boundary of each subfield represents the timing of scan pulses that are applied in linear succession to the scan electrodes 22 (Scani, i=1, 2, . . . , m). The time widths of the subfields 1SF, 2SF, . . . 6SF are set to ratios of 1:2:4:8:16:32, and a screen with 64 gray scale levels (0-63) can be displayed by combining the emission having those time ratios. For example, when a screen with the 29th gray scale should be displayed, the control within the one field TF is so conducted that the subfield 1SF (gray scale level 1), subfield 3SF (gray scale level 4), subfield 4SF (gray scale level 8), and subfield 5SF (gray scale level 16) emit light. As shown in FIG. 6, in one subfield, a voltage shown on the waveform Sus1 is applied to the first sustain electrode 23, and a voltage shown by a waveform Sus2 is applied to the second sustain electrode 24. A voltage shown on the waveforms Scan1, Scan2 is successively applied to the scan electrode 22. In FIG. 6, waveforms for the two electrodes of the scan electrodes 22 are only shown; similar waveforms are applied to the third line and subsequent lines, with the erase pulse p and scan pulse a being successively shifted. A voltage shown on the waveform Data is applied to the data electrode 25.

The wall voltage arrangements shown in FIG. 7(1) to FIG. 7(8) depict the wall voltages of the unit cells 26 to which the voltage of the waveform Scan1 are applied with timings (1) to (8) shown in FIG. 6, respectively. Thus, as shown in FIG. 6, one subfield starts from the application of an erase pulse p serving as an initialization pulse. In FIG. 7(1), the final sustain discharge in a subfield preceding this subfield is shown. This sustain discharge is conducted between the first sustain electrode 23 and second sustain electrode 24, a positive wall charge is formed on the first sustain electrode 23 and a negative wall charge is formed on the second sustain electrode 24 by the final sustain pulse. If a sustain pulse f of a positive polarity is applied to the first sustain electrode 23, a surface discharge is generated between the two electrodes. As a result, the polarity of the wall voltage of the first sustain electrode 23 and second sustain electrode 24 is inverted and the wall voltage assumes the arrangement shown in FIG. 7(2).

Then, at the timing (2) shown in FIG. 6, a sustain pulse f is applied to the second sustain electrode 24, an erase pulse p is applied to the scan electrode 22, and an erase data pulse q is applied to the data electrode 25. These erase pulse p and erase data pulse q are equivalent to initialization pulses, and serve to reset the wall charge when a sustain discharge is generated in the previous subfield and to facilitate writing by the priming effect caused by the discharge. Before the erase pulse p is applied, a scan base voltage Vbw of a positive potential is applied to the scan electrode 22 and the data electrode 25 assumes a GND potential. Therefore, the positive charge of the spatial charge generated in the sustain discharge is drawn onto the data electrode 25, and the negative charge is drawn onto the scan electrode 22, thereby forming wall charges. Thus, opposing erase preliminary discharges are generated between the scan electrode 22 and data electrode 25 because the erase pulse p is applied to the scan electrode 22, the potential of this scan electrode 22 became GND, and the potential of the data electrode 25 became Vd.

As a result, as shown in FIG. 7(3), the wall charge on the scan electrode 22 assumes a positive polarity. At this time, the sustain pulse f is applied to the second sustain electrode 24 adjacent to the scan electrode 22 and this sustain electrode assumes a positive potential. Therefore, the spatial charge generated by the opposing discharge shown in FIG. 7(2) is drawn onto the second sustain electrode 24, a negative wall voltage is formed, and a wall voltage arrangement shown in FIG. 7(3) is assumed. Then, in timing (3) shown in FIG. 6, the sustain pulse f applied to the second sustain electrode 24 ends, the erase pulse p also ends, and the potential of the scan electrode 22 returns to the scan base voltage Vbw. As a result, as shown in FIG. 7(3), under the effect of a positive wall voltage formed on the scan electrode 22 and a negative wall voltage formed on the second sustain electrode 24, an erase discharge is generated between the two electrodes.

Here, the first sustain electrode 23, second sustain electrode 24, and data electrode 25 are at the GND potential and the scan electrode 22 is an the positive potential. Therefore, as shown in FIG. 7(4), a negative wall voltage is formed on the scan electrode 22 and a positive wall voltage is formed on other electrodes. The initialization is thereby completed and a state is assumed in which writing is possible.

Prior to this stage, as is described above, the sustain discharge is generated in the previous subfield. In the case where no sustain discharge is generated in the previous subfield, the erase data pulse q is not applied to the data electrode 25 when the erase pulse p is applied to the scan electrode 22. In the case where a sustain discharge is not generated in the previous subfield, the arrangement shown in FIG. 7(4), which is the wall voltage arrangement immediately prior to writing of the previous subfield, is maintained unchanged. In this wall voltage state, if the erase data pulse q is not applied, the erase preliminary discharge is not generated. If the erase preliminary discharge is not generated, the wall charges on the scan electrode 22 and second sustain electrode 24 are not reversed. Therefore, the next erase discharge is not generated. Thus, the wall voltage arrangement of the previous subfield shown in FIG. 7(4) is retained unchanged and this wall voltage arrangement is identical to that obtained in the case where a sustain discharge is generated in the previous subfield.

Then, a write operation for writing the display data is started. Specifically, at the timing (4) shown in FIG. 6, a scan pulse a is applied to the scan electrode 22. Because a negative wall charge is formed on the scan electrode 22 and a positive wall charge is formed on the data electrode 25, if a data pulse e of a positive potential is applied to the data electrode 25 at this time, a write discharge is generated between the scan electrode 22 and data electrode 25. At the same time, a sustain pulse f is applied to the second sustain electrode 24, a voltage Vs is produced between the scan electrode 22 and second sustain electrode 24, the spatial charge generated by the write discharge is drawn to the second sustain electrode 24, and a negative wall voltage is formed on the second sustain electrode 24, as shown in FIG. 7(5). The write operation ends in this state. Subsequently, the sustain pulse f that has been applied to the second sustain electrode 24 ends in a state in which the scan pulse a is applied to the scan electrode 22. Then, a sustain pulse f is applied to the first sustain electrode 23. As a result, under the effect of the negative wall charge formed on the second sustain electrode 24, as shown in FIG. 7(5), the initial sustain discharge is generated between the first sustain electrode 23 and second sustain electrode 24.

Immediately thereafter, while the sustain discharge has not yet completely ended, the scan pulse a ends at the timing (6) shown in FIG. 6 and the potential of the scan electrode 22 is pulled up to the scan base voltage Vbw. The difference in time between the timing (5) and timing (6) shown in FIG. 6 is from about 0.5 μsec to about 1.5 μsec. Because the potential of the scan electrode 22 is pulled up while this sustain discharge is being maintained, as shown in FIG. 7(6), the spatial charge of negative polarity that is generated by the this sustain discharge is pulled onto the scan electrode 22 and a negative wall voltage is formed. As a result, a wall voltage arrangement shown in FIG. 7(7) is assumed. After this, a sustain discharge providing for light emission of the display is generated each time the electrode to which the sustain pulse f is applied is changed, and the wall voltage arrangements shown in FIG. 7(7) and FIG. 7(8) are formed alternately. On the other hand, if the data pulse e is not applied when the scan pulse a is applied, the write discharge is not generated and the wall voltage arrangement remains in the state shown in FIG. 7(4). Therefore, almost identical wall voltage is formed and remains on the first sustain electrode 23 and second sustain electrode 24, and no sustain discharge is thereafter generated even if the sustain pulse f is applied. Thus, the generation of the sustain discharge is controlled by the presence or absence of the write discharge.

As described hereinabove, in the first embodiment, the scan electrodes 22 are provided separately in addition to the sustain electrode pairs (sustain electrodes 23, 24) that cause the generation of the sustain discharge, the Address-While-Display drive, in which the scan pulse a is applied at the same timing as the sustain pulse f, is conducted for each subfield, and when the scan pulse a is applied to the scan electrode 22, the wall voltage generated by the wall charge formed on the transparent dielectric layer 65 present on the scan electrode 22 is set larger in the negative voltage direction than the wall voltage generated by the wall charge formed on the same transparent dielectric layer 65 located on the sustain electrode pair. Therefore, the display luminance level is increased, it is not necessary to increase the scale of the power source circuit, and a wide drive margin is obtained.

In the first embodiment, the erase data pulse q is applied to the data electrode 25 only in the case where the sustain discharge is conducted in the previous subfield. Therefore, when the sustain discharge is not generated for a long time due to a black display, no spatial charge is present in the discharge space 69 and writing sometimes cannot be conducted reliably. This problem is dealt with in the below-described second embodiment.

Second Embodiment

In the second embodiment, the erase data pulse q is necessarily applied to the data electrode 25 when the erase pulse p is applied to the scan electrode 22. As a result, an erase preliminary discharge and erase discharge are generated for each subfield, regardless of the discharge state of the previous subfield. Therefore, even when the sustain discharge is not generated for a long time due to a black display, the discharge for initialization will be generated and the state of the wall charge can be always maintained at a fixed level. Moreover, the priming effect can be obtained, a certain spatial charge can be always provided in the discharge space 69, and reliable writing can be conducted even after a long-term black display.

In the second embodiment, the erase data pulse q is applied and the erase preliminary discharge and erase discharge are generated for each subfield. Therefore, for certain wall charge states, the luminance of the black level is not sufficiently reduced. Therefore, this problem is resolved in the below-described third embodiment.

Third Embodiment

In the third embodiment, the erase data pulse q is applied to the data electrode 25 only in a certain subfield. For example, the erase data pulse q is applied only in the first subfield, regardless of the generation of the sustain discharge in the previous subfield. As a result, the discharge occurrence frequency during black display in one field is represented only by the erase preliminary discharge and erase discharge of the first subfield, and the luminance of the black level is substantially reduced if compared with the case where the erase preliminary discharge and erase discharge occur for each subfield as in the second embodiment.

Fourth Embodiment

Figure 8:
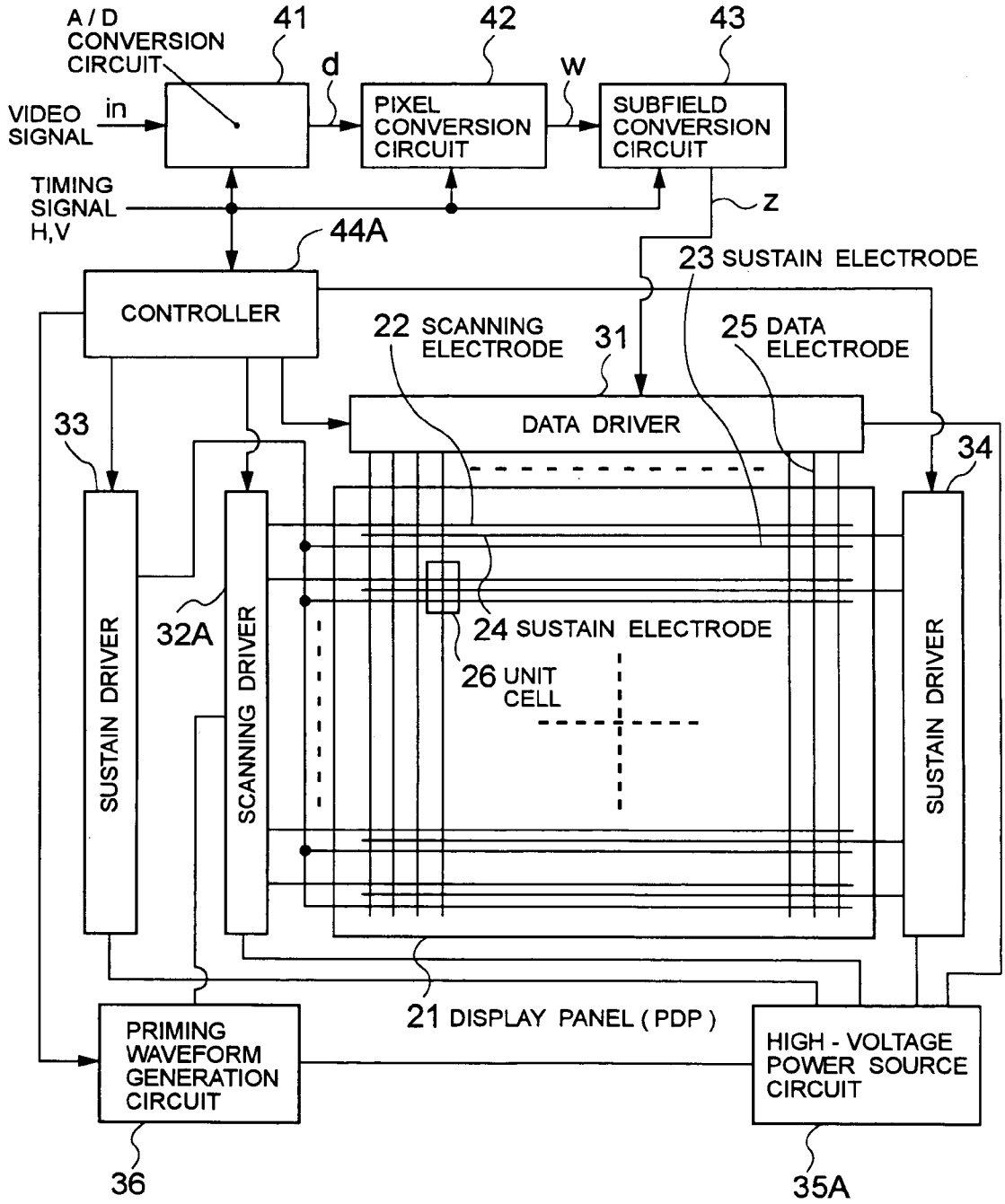
FIG. 8 is a block diagram illustrating an electric configuration of the plasma display device of a fourth embodiment of the present invention.

FIG. 8 is a block diagram illustrating the electric configuration of the plasma display device according to the fourth embodiment of the present invention. In this figure, the elements common with the elements shown in FIG. 1 that illustrates the first embodiment are assigned with common reference symbols.

In the plasma display device of this embodiment, a scan driver 32A, a high-voltage power source circuit 35A, and a controller 44A of different configurations are provided instead of the scan driver 32, high-voltage power source circuit 35, and controller 44 shown in FIG. 1. Further, a priming waveform generation circuit 36 is added. The high-voltage power source circuit 35A supplies a prescribed high-voltage power to the priming waveform generation circuit 36, in addition to having the functions of the high-voltage power source circuit 35. The priming waveform generation circuit 36 uses the high-voltage power supplied from the high-voltage power source circuit 35 to generate a ramp waveform to be applied to the scan electrodes 22 in the priming interval. The scan driver 32A applies the ramp waveform generated by the priming waveform generation circuit 36 to the scan electrodes 22, in addition to having the functions of the scan driver 32. The controller 44A controls the operation timing of the priming waveform generation circuit 36, in addition to having the functions of the controller 44. In other aspects the configuration is identical to that shown in FIG. 1.

Figure 9:
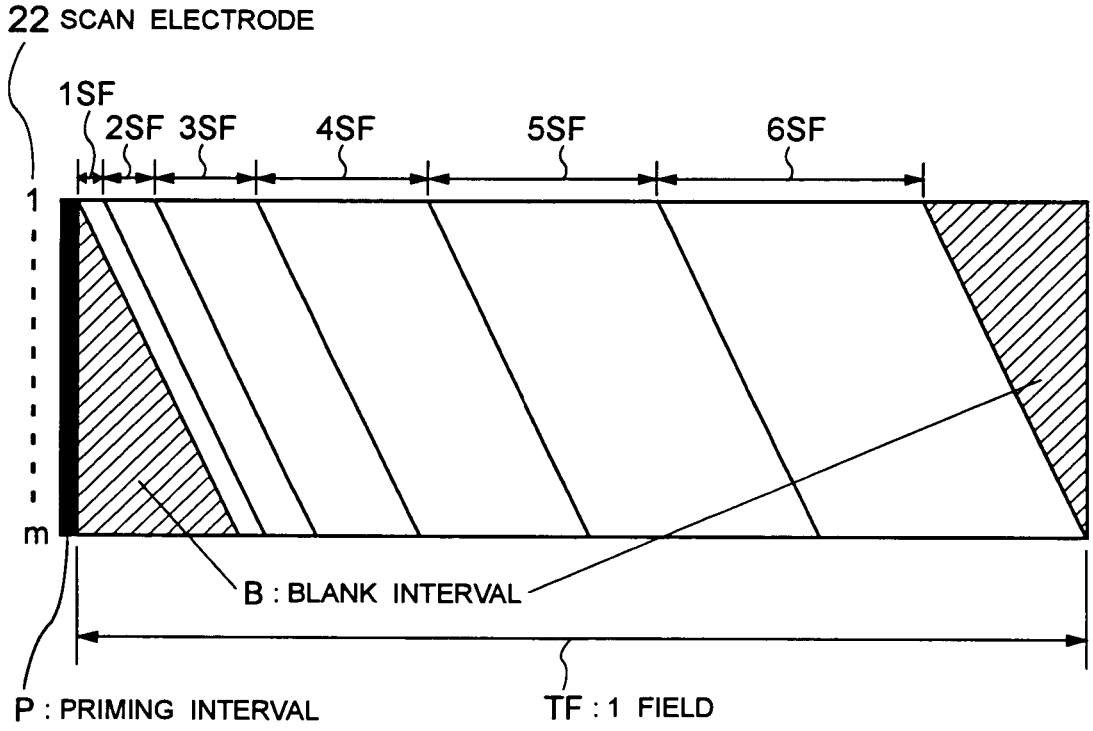
FIG. 9 shows the configuration of one field used for the plasma display device shown in FIG. 8.
Figure 10:
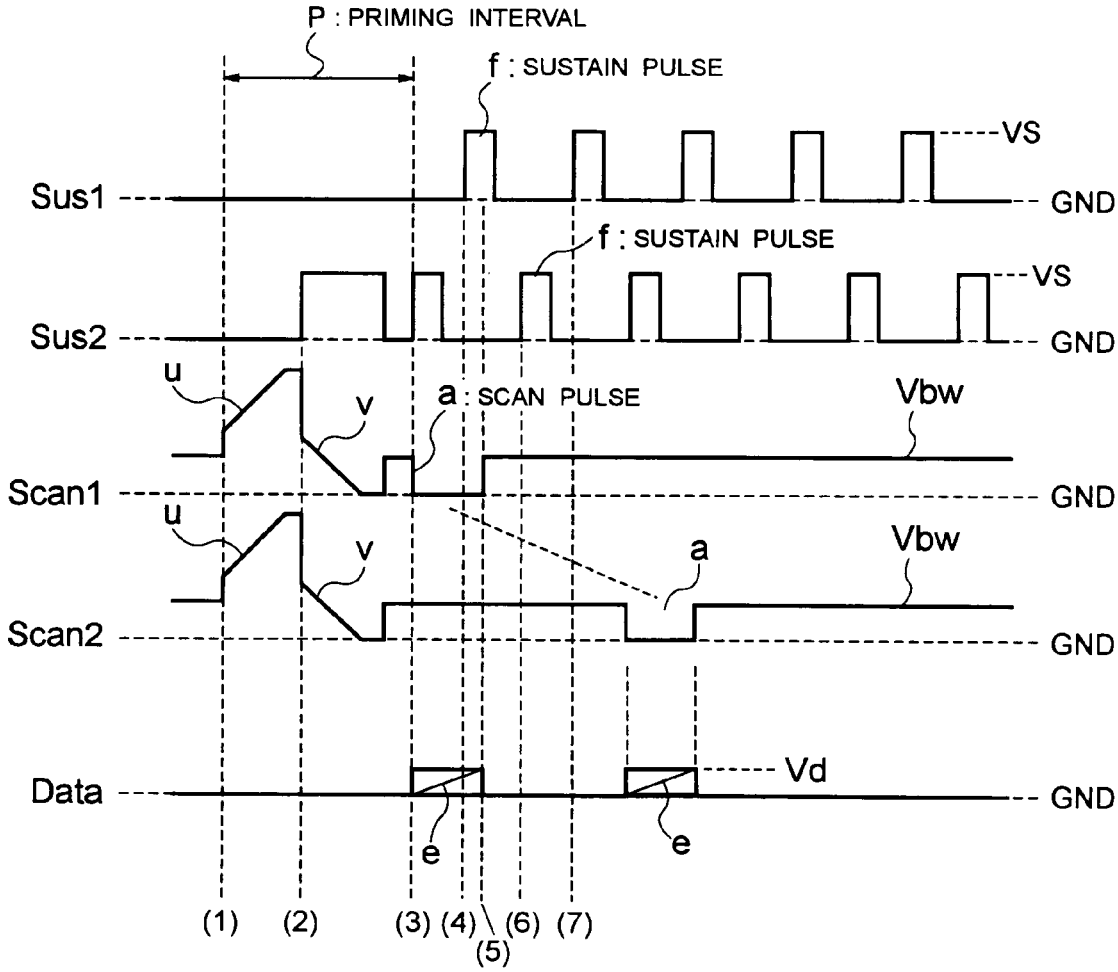
FIG. 10 shows drive waveforms in a priming interval and a write portion of the very first subfield (1SF) shown in FIG. 9.

FIG. 9 shows the configuration of one field TF. FIG. 10 shows drive waveforms in the priming interval P and in the write portion of the very first subfield (1SF) shown in FIG. 9. FIG. 11(1) to FIG. 11(7) show wall voltage arrangements in a unit cell 26 at seven different timing.

The processing of the drive method used in the plasma display device of this embodiment will be described below with reference to those figures.

As shown in FIG. 9, one field TF is divided, for example, into six subfields 1SF, 2SF, . . . , 6SF. Further, a priming interval P is provided in the head section. As shown in FIG. 10, the drive voltage including the voltage of a ramp waveform is simultaneously applied to all the scan lines 22 within the priming interval P. Then, the scan pulse a is successively applied to the scan electrodes 22 (from the first to the m-th scan electrode 22). An inclined line of the boundary of each subfield represents the timing of scan pulses that are applied in linear succession to each scan electrode 22 (Scani, i=1, 2, . . . , m). Because the scan pulses a are applied in linear succession, the drive operation is not conducted during a certain period (i.e., a blank interval B is present), as shown in FIG. 9. The electric potential of each electrode at this time is as follows: the scan electrodes 22 are at Vbw and the first sustain electrode 23 and second sustain electrode 24 are at a GND potential. The subfields 1SF to 6SF are configured in the same manner as in the first embodiment. At the end of the one field, the blank interval B is provided again. In this blank interval B, the potential identical to that of the blank interval B after the priming interval P is applied to each electrode, no drive operation is conducted, and the wall charge remains unchanged.

As shown in FIG. 10, a voltage shown on the waveform Sus1 is applied to the first sustain electrode 23, and a voltage shown by a waveform Sus2 is applied to the second sustain electrode 24. A voltage shown on the waveforms Scan1, Scan2 is successively applied to the scan electrodes 22. In FIG. 10, voltage waveforms for the two-display-line-worth of scan electrodes 22 are only shown; similar voltage waveforms are applied for the third line and subsequent display lines, with successive shifting of the scan pulse a. A voltage shown on the waveform Data is applied to the data electrode 25.

The wall voltage arrangements shown in FIG. 11(1) to FIG. 11(7) respectively show the wall voltages of the unit cells 26 to which the voltage of the waveform Scan1 is applied with timings (1) to (7) shown in FIG. 10. Before the priming interval P, the sixth subfield of the previous field (not shown in the figure) is located. If the sustain discharge is generated when the sixth subfield of the previous field has ended, the erase operation is conducted and a wall voltage arrangement shown in FIG. 7(4) is assumed. This is similar to the first embodiment. On the other hand, even when no sustain discharge is generated, the wall voltage arrangement shown in FIG. 7(4) is assumed when the writing of the sixth subfield of the previous field is conducted. Therefore, at the timing (1) shown in FIG. 10 (i.e., at the beginning of the priming interval P), all the unit cells assume a wall voltage arrangement shown in FIG. 11(1).

Then, a transition is made into the priming interval P to activate the inside of the unit cell 26. In the priming interval P, the voltage with a ramp waveform is applied to the scan electrode 22. Specifically, the voltage u with the first priming waveform is applied to the scan electrode 22 and the potential of this scan electrode 22 increases gradually. A negative wall charged is formed on the scan electrode 22 and a positive wall charge is formed on the adjacent second sustain electrode 24, but even if the wall voltage caused by those charges is included, a weak discharge is generated between the two electrodes when a difference in potential equal to or exceeding the discharge initiation voltage is applied to the discharge space of the cell. If the weak discharge is generated, the wall voltage changes in the direction of increasing the wall charge in the vicinity of the write surface discharge gap 63. At this time, an opposing weak discharge is also generated because the voltage applied to the discharge space exceeds the opposing discharge initiation voltage between the scan electrode 22 and data electrode 25, and also exceeds the surface discharge initiation voltage. Therefore, at the timing (2) shown in FIG. 10, the wall voltage arrangement is such that, as shown in FIG. 11(2), the wall voltage on the scan electrode 22 increases the negative voltage on the entire electrode surface and the wall voltage on the second sustain electrode 24 increases the positive voltage only in the vicinity of the write surface discharge gap 63.

Then the voltage v with the second priming waveform is applied to the scan electrode 22, and the potential of the scan electrode 22 gradually decreases. At this time, the potential of the adjacent second sustain electrode 24 is pulled up to the potential Vs and a weak discharge is generated that has a polarity opposite to that of the weak discharge generated when the first priming waveform u is applied. As a result, at the timing (3) shown in FIG. 10, the wall voltage arrangement returns to the state of the beginning of the priming interval P and assumes a state shown in FIG. 11(3). The priming interval P is thereby completed. The state of the wall voltage inside the unit cell 26 does not change before and after the priming interval P, as shown in FIGS. 11(1) and 11(3). However, a weak discharge is generated inside the unit cell 26, so that the space charge is generated and the inside of the unit cell 26 is activated. As a result, the next write discharge can be easily generated even when no sustain discharge is generated for a long time inside the unit cell 26, as in the case where a black display is displayed for a long time.

Then, a transition is made to a write operation for writing the display data. Specifically, at the timing (3) shown in FIG. 10, a scan pulse a is applied to the scan electrode 22. Because a negative wall charge is formed on the scan electrode 22 and a positive wall charge is formed on the data electrode 25, if a data pulse e of the positive potential is applied to the data electrode 25, then a write discharge is generated between the scan electrode 22 and data electrode 25. At the same time, the sustain pulse f is applied to the second sustain electrode 24, a voltage Vs is applied between the scan electrode 22 and the second sustain electrode 24, the space charge generated by the write discharge is pulled in, and a negative wall voltage is formed on the second sustain electrode 24, as shown in FIG. 11(4). The write operation ends in this state. Then, the sustain pulse f that is applied to the second sustain electrode 24 ends in a state in which the scan pulse a is applied to the scan electrode 22. Subsequently, the sustain pulse f is applied to the first sustain electrode 23. As a result, the very first sustain discharge is generated between the first sustain electrode 23 and the second sustain electrode 24, as shown in FIG. 11(4), by the negative wall charged formed on the second sustain electrode 24.

Immediately thereafter, while the sustain discharge has not yet been completed, the scan pulse a ends at the timing (5) shown in FIG. 10 and the potential of the scan electrode 22 is pulled up to Vbw. The difference in time between the timing (4) and timing (5) shown in FIG. 10 is from about 0.5 μsec to about 1.5 μsec. By pulling up the potential of the scan electrode 22 while the sustain discharge continues, the space charge of a negative polarity that is generated by the sustain discharge is pulled in on the scan electrode 22, and a negative wall voltage is formed as shown FIG. 11(5). As a result, a wall voltage arrangement shown in FIG. 11(6) is assumed. Then, the sustain discharge is generated, this discharge carrying out the light emission of the display each time the electrode to which the sustain pulse f is applied is changed, and the wall voltage arrangements shown in FIG. 11(6) and FIG. 11(7) are formed alternately.

On the other hand, in the case where the data pulse e is not applied when the scan pulse a is applied, the write discharge is not generated and the wall voltage arrangement remains in the state shown in FIG. 11(3). Therefore, an almost identical wall voltage is formed on the first sustain electrode 23 and second sustain electrode 24. Therefore, no sustain discharge is generated even if the sustain pulse f is applied. The generation of the sustain discharge can thus be controlled by the presence or absence of the write discharge.

As described above, in the fourth embodiment, the drive voltage including the ramp waveform voltage is applied at once to all the scan lines 22 in the priming interval P. Therefore, in addition to the merits of the first embodiment, the fourth embodiment has an additional merit that the next write discharge is easily generated even if a sustain discharge has not been generated for a long time in a unit cell 26.

With the Address-While-Display drive system described in the above-described embodiments, the data pulse e and erase data pulse q are applied to the data electrode 25 even while the sustain pulse f that generates a sustain discharge is applied to a sustain electrode pair. The sustain discharge is generated between the first sustain electrode 23 and second sustain electrode 24 in the sustain electrode pair. Therefore, the intensity and spread of the sustain discharge are determined by the difference in potential between the two electrodes. However, with the configuration in which the sustain electrode pair and data electrode 25 are installed opposite each other via the discharge space 69, as in the unit cell 26 shown in FIG. 3 of the above-described embodiments, not only the difference in potential between the two electrodes, but also the difference in potential between the data electrode 25 and sustain electrode pair affect the intensity and spread of the sustain discharge. In this case, when the sustain pulse f is applied and the sustain discharge is generated, and the data pulse e or erase data pulse q for writing or erasing the other scan line is applied and the potential of the data electrode 25 changes, then the state of the sustain discharge is affected. The resultant problem is that the emission luminance sometimes changes and irregular luminance sometimes occur in the display screen. This problem is resolved with the following fifth embodiment.

Fifth Embodiment

Figure 12:
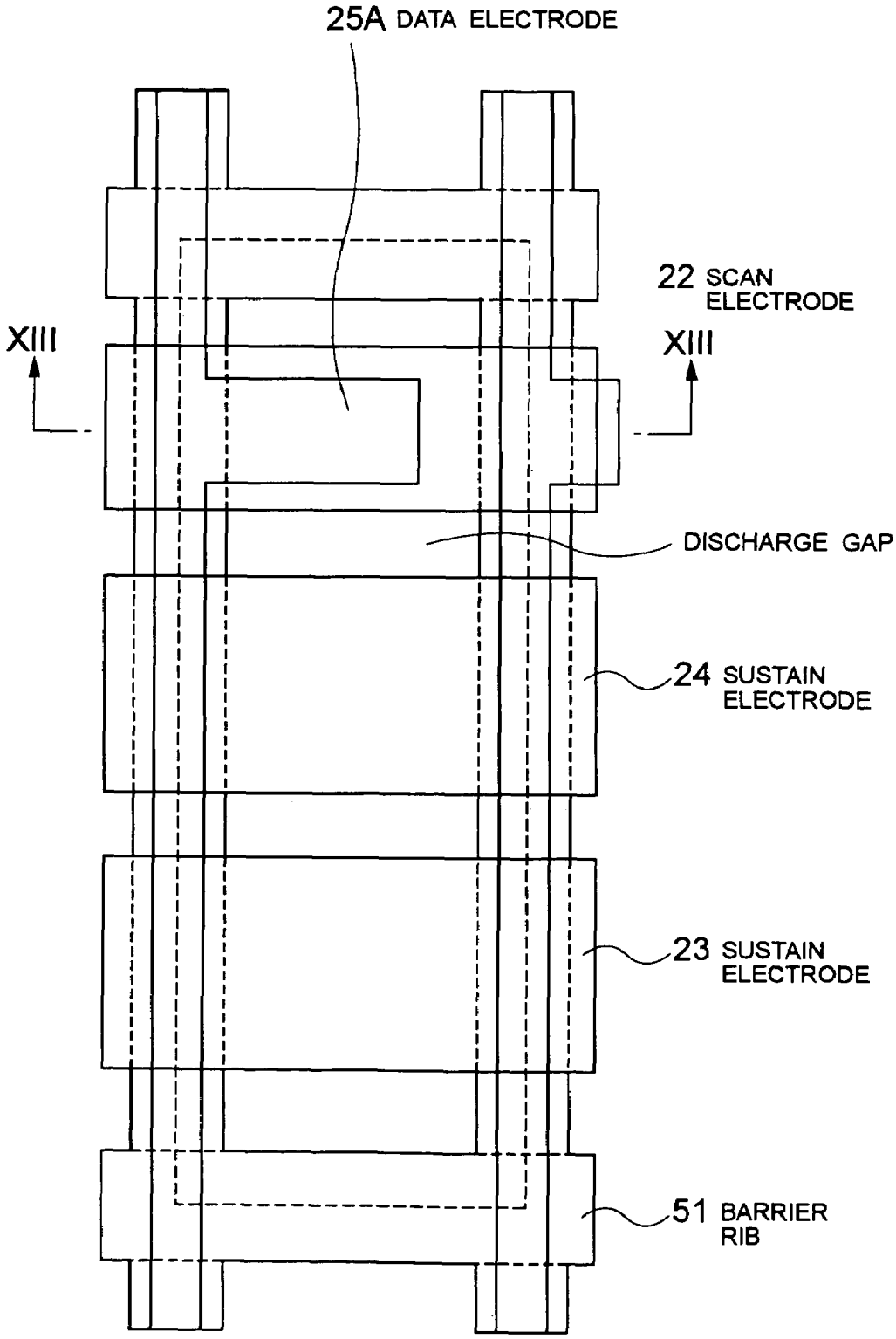
FIG. 12 is a major portion of the PDP according to a fifth embodiment of the present invention.
Figure 13:
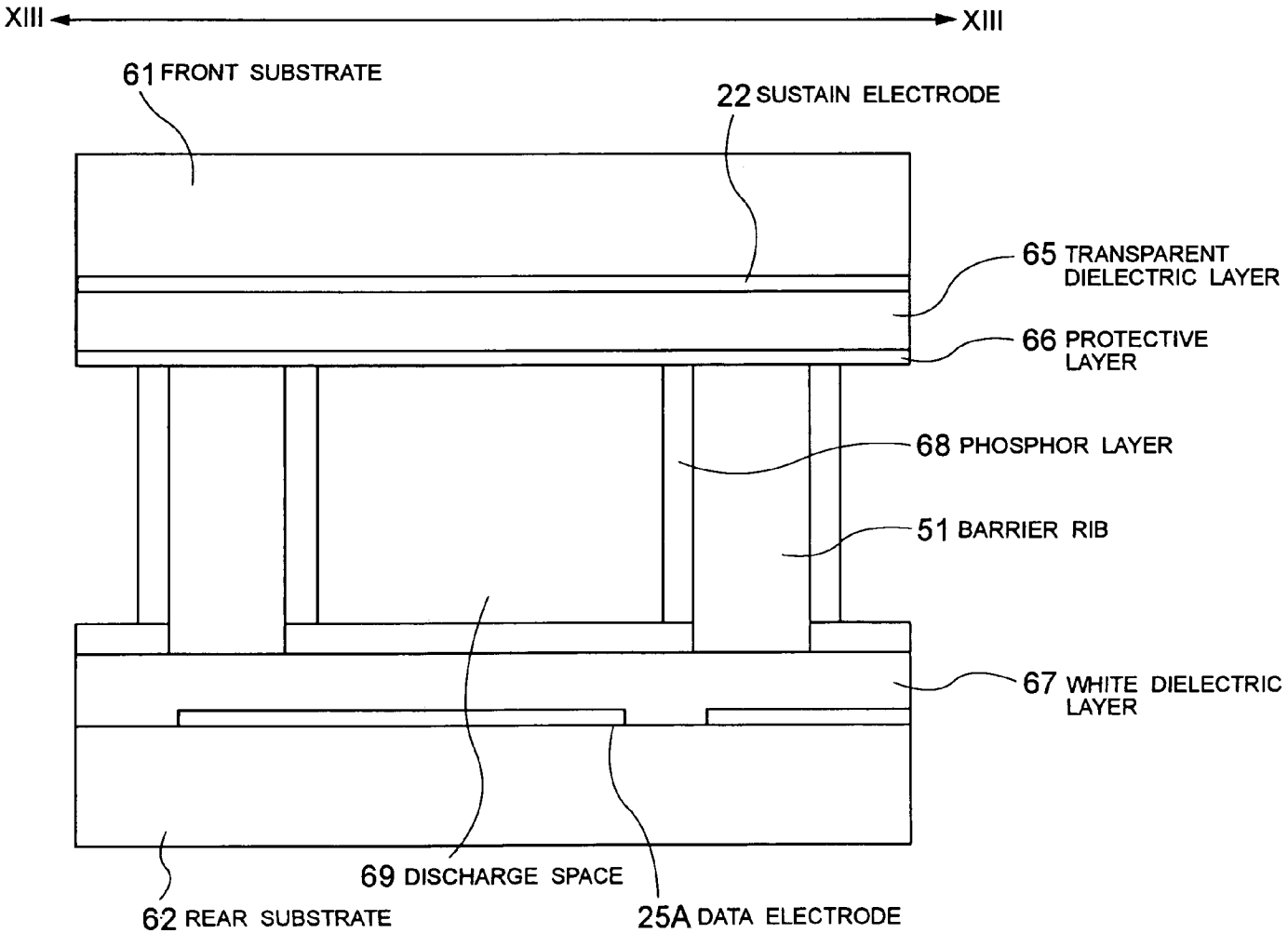
FIG. 13 is a cross-sectional view along the XIII-XIII line in FIG. 12.
Figure 14:
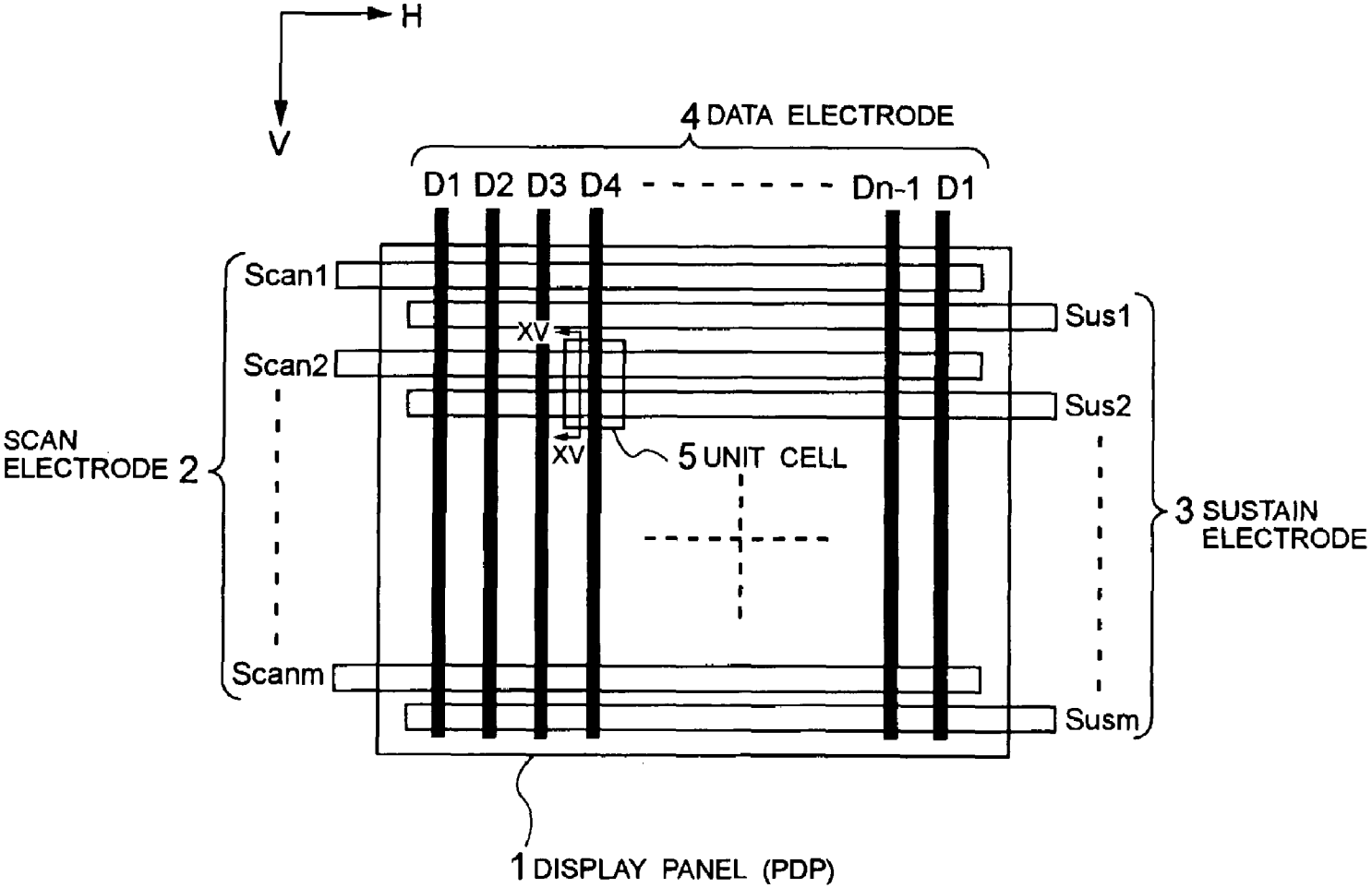
FIG. 14 is a structural drawing of the conventional plasma display device.
Figure 15:
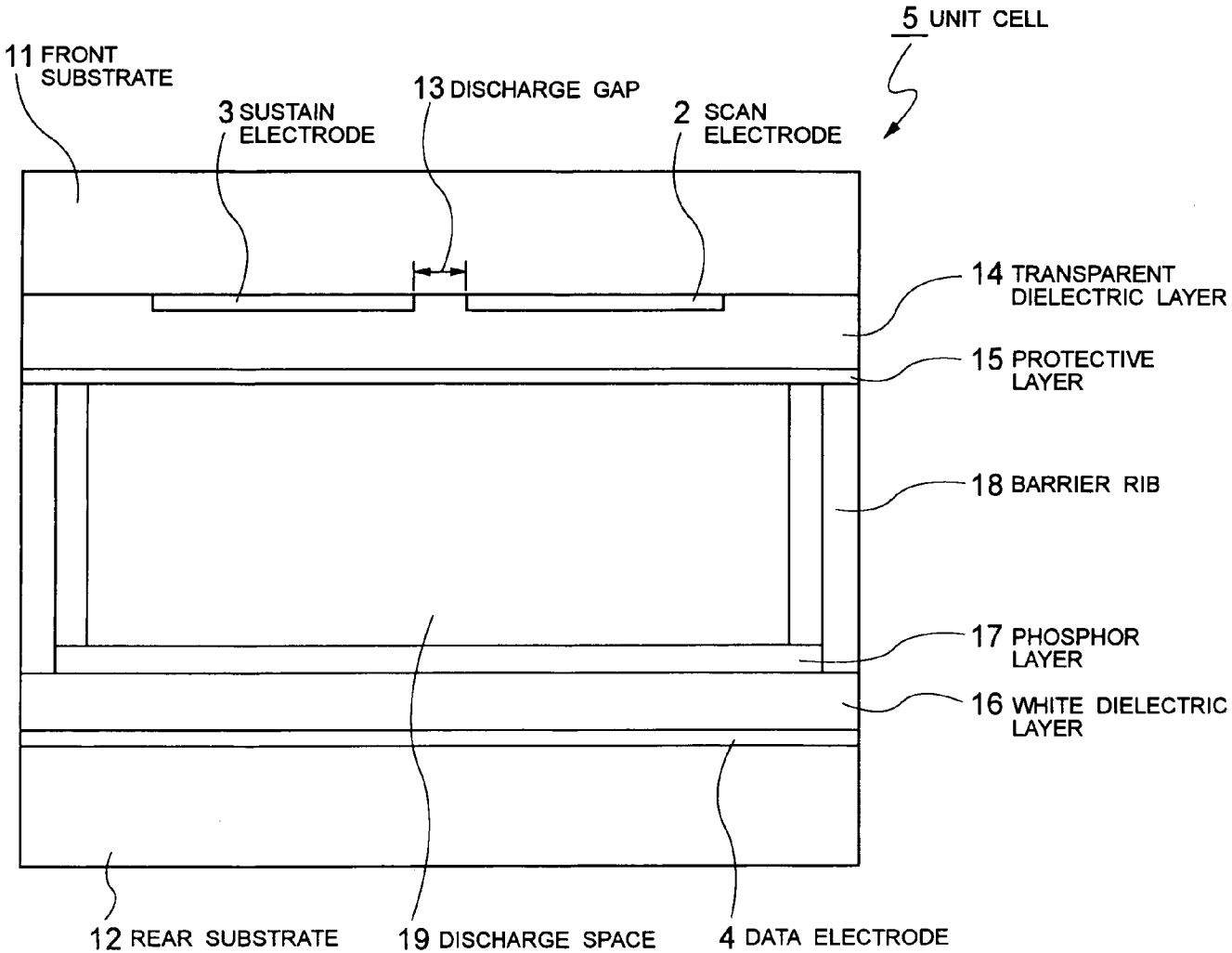
FIG. 15 is a cross-sectional view along the XV-XV line of the unit cell shown in FIG. 14.
Figure 16:
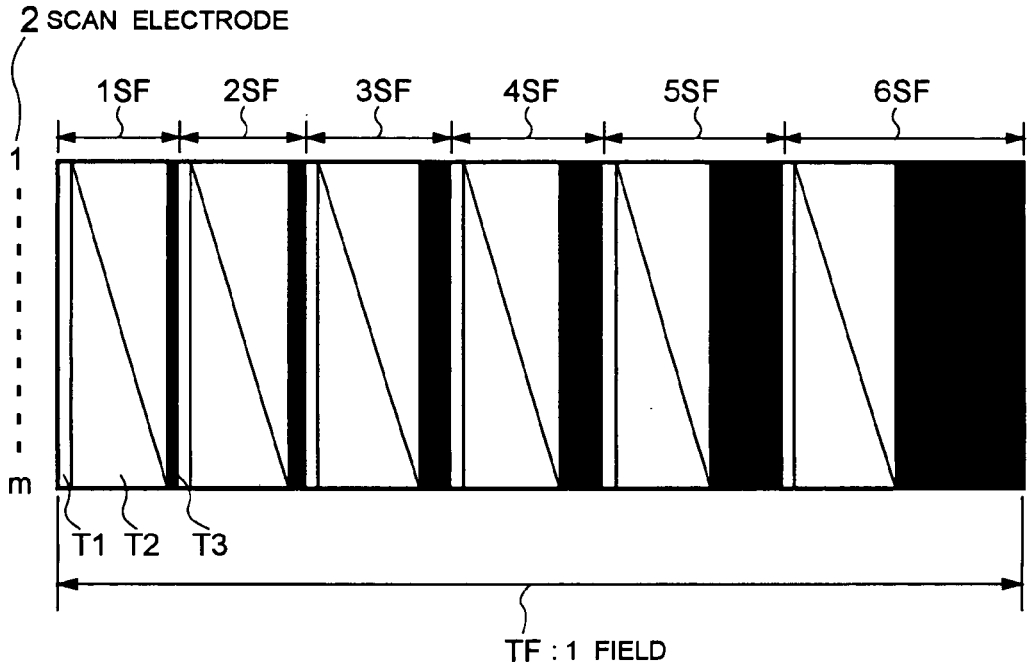
FIG. 16 illustrates the principle of a gray scale display method based on an Address Display-period separate drive system used in the plasma display device shown in FIG. 14.
Figure 17:
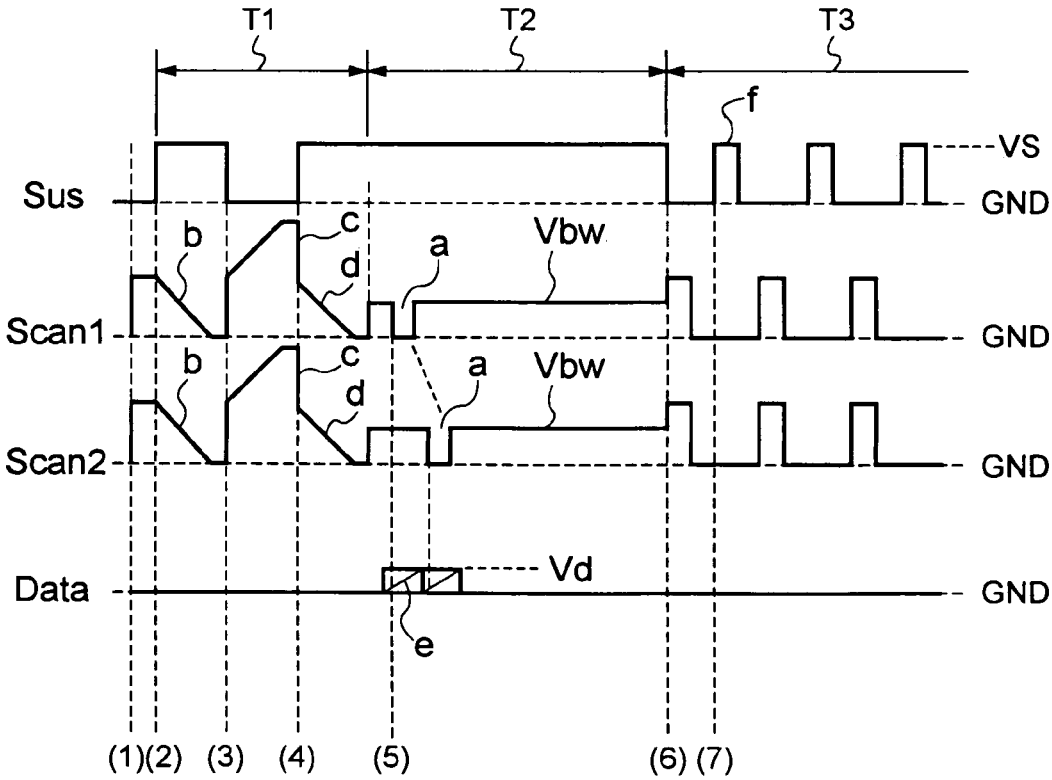
FIG. 17 shows a main part of the drive waveform used in the conventional Address Display-period separate drive system.
Figure 19:
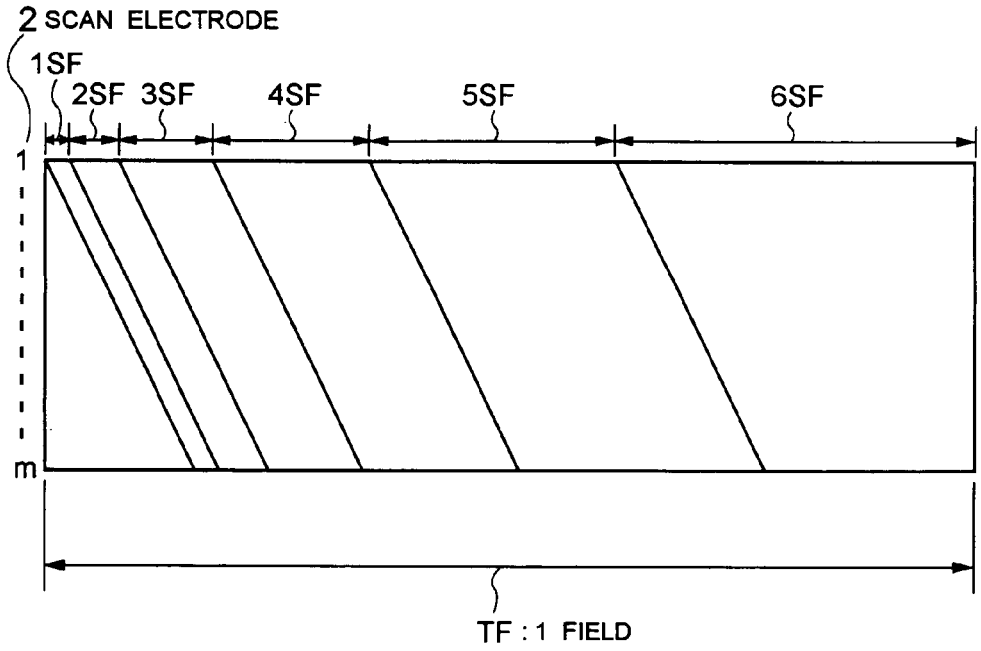
FIG. 19 shows the configuration of one field.
Figure 20:
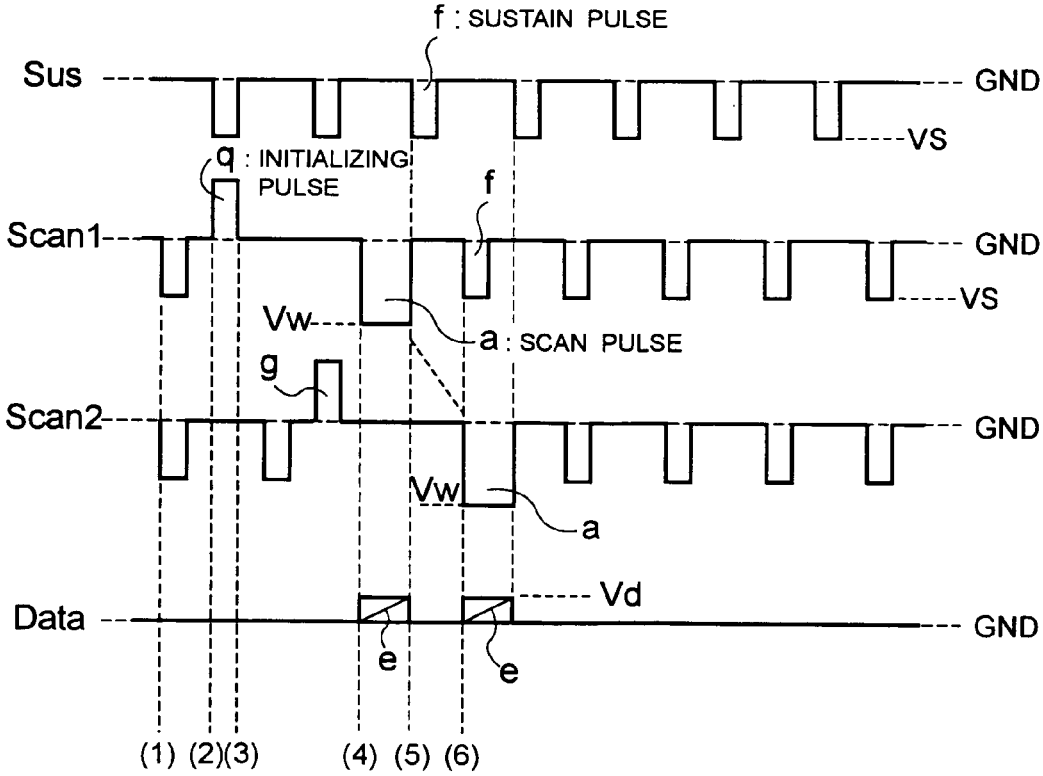
FIG. 20 shows a main part of the drive waveform used in the Address-While-Display drive system.
Figure 22:
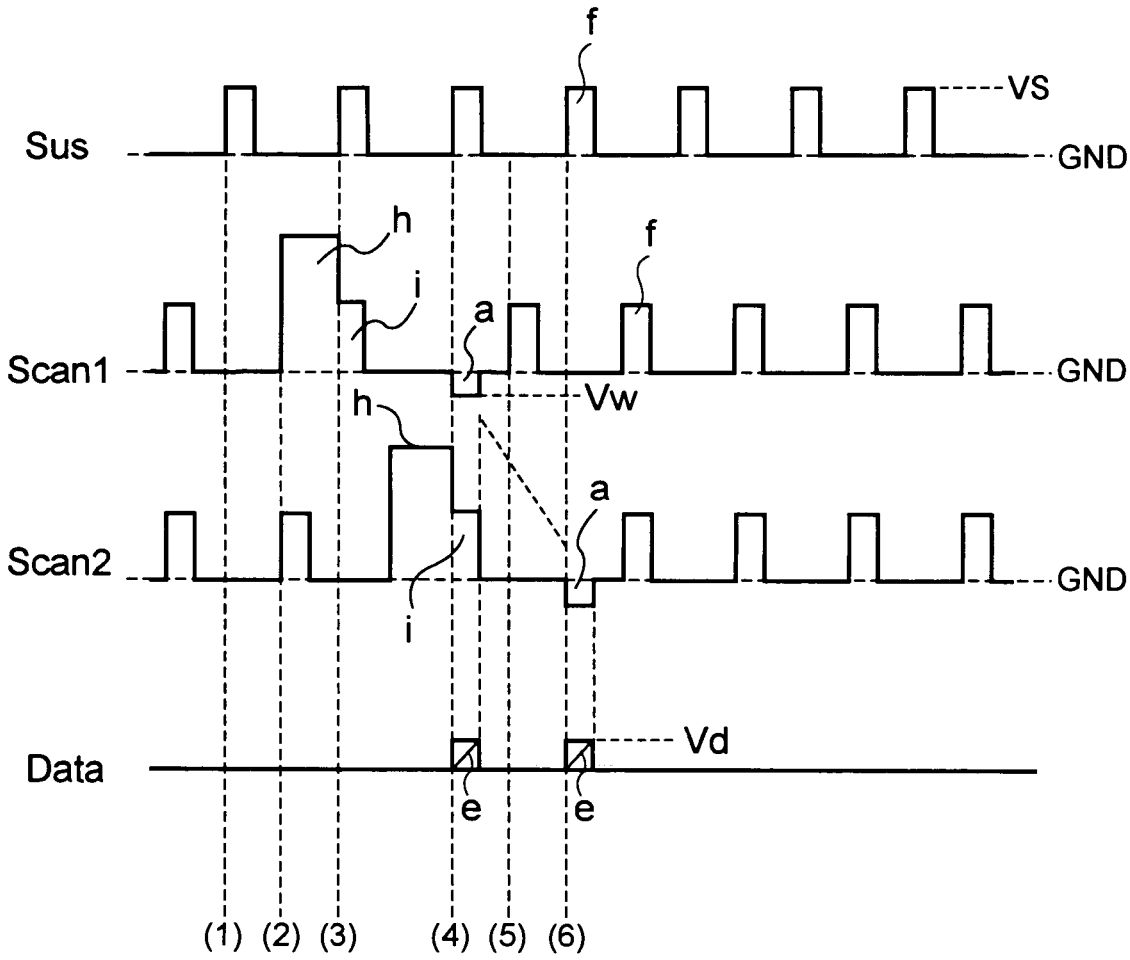
FIG. 22 shows a main part of the drive waveform used in the other Address-While-Display drive system.

FIG. 12 schematically illustrates a structure of a unit cell of the PDP according to the fifth embodiment of the present invention. The elements common with the elements shown in FIG. 3 are assigned with common reference symbols. FIG. 13 is a cross-sectional view along the XIII-XIII line in FIG. 12.

In the unit cell of the PDP of this embodiment, as shown in FIG. 12, a data electrode 25A of a different shape is provided in place of the data electrode 25 shown in FIG. 3. The data electrode 25A, as shown in FIG. 13, is disposed to be hidden on the barrier ribs 51 extending in the longitudinal (vertical) direction so that it faces the scan electrode 22 via the discharge space 69 and does not face the first sustain electrode 23 and second sustain electrode 24. As a result, the intensity and spread of the sustain discharge are practically unaffected by the fluctuations of the potential of the data electrode 25A. Therefore, the emission luminance does not change an no luminance irregularities occur in the display screen.

The embodiments of the present invention have been described in detail above with reference to the accompanying drawings, but the present invention is not limited to those embodiments. Various changes and modification may be made to the illustrated embodiments without departing from the spirit and scope of the invention.

For example, the number of subfields shown in FIG. 5 or FIG. 9 is six, but it may be any number according to the necessary number of gray scales. For instance, it may be eight. If one field is divided into eight subfields, the time widths of the subfields are set to ratios: 1:2:4:8: 16:32:64:128, and it is possible to display images with 256 gray scale levels (0-255).

A light-shielding layer (not shown in the figures) may be provided on the scan electrode 22 and write surface discharge gap 63 shown in FIG. 4, on the panel display screen side thereof. Discharge occur upon initialization, and this initialization discharge produces light emission which is not part of a displayed image. The light-shielding layer can shield the light emission caused by this initialization discharge.

The present invention can be employed in all the plasma display devices that require a higher display luminance level than the devices with an Address Display-period separate drive system.

This application is based on a Japanese Patent Application No. 2004-171327 filed on Jun. 9, 2004, and the entire disclosure thereof is incorporated herein by reference.

What is claimed is:

1. A plasma display device comprising:

a plasma display panel; and a drive unit for driving said plasma display panel, based on a plurality of subfields which are obtained by dividing one field of a display screen into the plurality of subfields, the plurality of subfields having respective weights based on gray scale levels, wherein said plasma display panel includes:

a first substrate and a second substrate disposed opposite each other, the first substrate having a first surface which faces the second substrate, and the second substrate having a first surface which faces the first substrate;

a plurality of sustain electrode pairs, each said sustain electrode pair having a first sustain electrode and a second sustain electrode disposed parallel to each other with a first discharge gap therebetween on the first surface of said first substrate, to generate a sustain discharge upon application of a sustain pulse;

a plurality of scan electrodes disposed parallel to said sustain electrode pairs with a second discharge gap therefrom on the first surface of said first substrate and having successively applied thereto scan pulses for conducting write discharge according to a video signal;

a plurality of data electrodes provided in a pattern crossing each said sustain electrode pair on the first surface of said second substrate;

a plurality of unit cells formed in each intersection region of said plurality of sustain electrode pairs and said plurality of data electrodes;

a first dielectric layer covering said plurality of sustain electrode pairs and scan electrodes; and a second dielectric layer covering said plurality of data electrodes, and said drive unit is configured to conduct, for each said subfield, Address-While-Display drive in which said scan pulses are applied at the same timing as said sustain pulses; and to set a first wall voltage generated by a first wall charge formed on said first dielectric layer located on said scan electrodes higher in a negative voltage direction than a second wall voltage generated by a second wall charge formed on said first dielectric layer located on said sustain electrode pairs when said scan pulses are applied to said scan electrodes.

2. The plasma display device according to claim 1, wherein for each said subfield, a ratio of the weight of said subfield concerned, to a weight of an adjacent subfield with a smaller weight value than that of said subfield concerned is set to about 2:1.

3. The plasma display device according to claim 1, wherein said drive unit is configured to apply to said scan electrodes an erase pulse of a negative polarity for initializing said wall charge after said sustain discharge has been generated, to cause generation of an erase discharge at a timing of rise when said erase pulse ends, and to set a potential of said scan electrodes during the generation of said erase discharge higher than a potential of said sustain electrode.

4. The plasma display device according to claim 3, wherein said drive unit is configured to set identical potentials of said first and second sustain electrodes during the generation of said erase discharge.

5. The plasma display device according to claim 3, wherein said first sustain electrode in each said sustain electrode pair is closer to said scan electrode than the second sustain electrode, and said drive unit is configured to generate said erase discharge between said scan electrode and the closer sustain electrode of said sustain electrode pair.

6. The plasma display device according to claim 3, wherein said drive unit is configured to generate a preliminary erase discharge in an opposite direction between said scan electrode and said data electrode by applying an erase data pulse to said data electrode at a same timing as application of said erase pulse.

7. The plasma display device according to claim 3, wherein said first sustain electrode in each said sustain electrode pair is closer to said scan electrode than the second sustain electrode, and said drive unit is configured to apply said erase pulse so that a potential of said scan electrode differs from a potential of said closer sustain electrode when said sustain pulse of positive polarity is applied to the closer sustain electrode.

8. The plasma display device according to claim 1, wherein said first sustain electrode in each said sustain electrode pair is closer to said scan electrode than the second sustain electrode, and said drive unit is configured to apply said scan pulse so that a potential of said scan electrode differs from a potential of said closer sustain electrode when said sustain pulse of positive polarity is applied to the closer sustain electrode.

9. The plasma display device according to claim 1, wherein said drive unit is configured to alternate the first and second sustain electrodes of said sustain electrode pair to which said sustain pulse is applied, while said scan pulse is being applied, and to end said scan pulse after the sustain discharge is generated in said sustain electrode pair.

10. The plasma display device according to claim 9, wherein when said scan pulse is applied and a write discharge is generated, said drive unit ends said scan pulse while said sustain pulse is being applied to the sustain electrode of said sustain electrode pair which is initially alternated.

11. The plasma display device according to claim 1, wherein said drive unit is configured to equalize a potential of said scan electrode obtained when said scan pulse is applied and a potential of said sustain electrode obtained when said sustain pulse is not applied.

12. The plasma display device according to claim 1, wherein said drive unit is configured to apply only a sustain pulse to said sustain electrode pair.

13. The plasma display device according to claim 6, wherein said drive unit is configured to apply said erase data pulse only when the write discharge is conducted by said scan pulses and the sustain discharge is generated in the prior subfield.

14. The plasma display device according to claim 6, wherein said drive unit is configured to apply said erase data pulse at prescribed timing, regardless of a display image.

15. The plasma display device according to claim 6, wherein said drive unit is configured to apply a ramp waveform to said scan electrode at prescribed timing, regardless of a display image.

16. The plasma display device according to claim 6, wherein said drive unit is configured to set a voltage of the data pulse corresponding to a video signal applied to said data electrode synchronously with said scan pulse the same as a voltage of said erase data pulse.

17. The plasma display device according to claim 1, wherein said plasma display panel also has a light shielding layer provided on a panel display screen side of each said second discharge gap and each said scan electrode.

18. The plasma display device according to claim 1, wherein said plasma display panel is configured so that each of said sustain electrode pairs and each of said data electrodes are not disposed opposite each other over said first and second dielectric layers.

19. A drive method for a plasma display device, said plasma display device including:

a plasma display panel; and a drive unit for driving said plasma display panel based on a plurality of subfields which are obtained by dividing one field of a display screen into the plurality of subfields, the plurality of subfields having respective weights based on gray scale levels, and in which said plasma display panel includes:

a first substrate and a second substrate disposed opposite each other, the first substrate having a first surface which faces the second substrate, and the second substrate having a first surface which faces the first substrate;

a plurality of sustain electrode pairs, each said sustain electrode pair having a first sustain electrode and a second sustain electrode disposed parallel to each other with a first discharge gap therebetween on the first surface of said first substrate, to generate a sustain discharge upon application of a sustain pulse;

a plurality of scan electrodes disposed parallel to said sustain electrode pairs with a second discharge gap therefrom on the first surface of said first substrate, to have successively applied thereto the scan pulses for conducting write discharge according to a video signal;

a plurality of data electrodes provided in a pattern crossing each said sustain electrode pair on the first surface of said second substrate;

a plurality of unit cells formed in each intersection region of said plurality of sustain electrode pairs and said plurality of data electrodes;

a first dielectric layer covering said plurality of sustain electrode pairs and scan electrodes; and a second dielectric layer covering said plurality of data electrodes; wherein said drive unit conducts, for each said subfield, Address-While-Display drive in which said scan pulses are applied at the same timing as said sustain pulses and sets a first wall voltage generated by a first wall charge formed on said first dielectric layer located on said scan electrodes higher in a negative voltage direction than a second wall voltage generated by a second wall charge formed on said first dielectric layer located on said sustain electrode pairs when said scan pulses are applied to said scan electrodes.

* * * * *